US006269668B1

(12) United States Patent
Shiraishi et al.

(10) Patent No.: US 6,269,668 B1
(45) Date of Patent: Aug. 7, 2001

(54) COLD TANDEM ROLLING METHOD AND COLD TANDEM ROLLING MILL

(75) Inventors: Toshiyuki Shiraishi; Shigeru Ogawa; Shyuichi Hamauzu; Atsushi Ishii, all of Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 08/945,334

(22) PCT Filed: Mar. 18, 1997

(86) PCT No.: PCT/JP97/00883

§ 371 Date: Oct. 22, 1997

§ 102(e) Date: Oct. 22, 1997

(87) PCT Pub. No.: WO97/34715

PCT Pub. Date: Sep. 25, 1997

(30) Foreign Application Priority Data

Mar. 18, 1996 (JP) ..... 8-060863
Mar. 18, 1996 (JP) ..... 8-061019
Nov. 11, 1996 (JP) ..... 8-298577

(51) Int. Cl.[7] ..... B21B 37/48

(52) U.S. Cl. ..... 72/8.6; 72/9.1; 72/11.4; 72/205

(58) Field of Search ..... 72/8.6, 8.7, 11.4, 72/12.3, 12.4, 16.6, 18.4, 19.2, 205, 9.1; 11/11.7

(56) References Cited

U.S. PATENT DOCUMENTS 3,648,494 * 3/1972 Lautenschlager ..... 72/8
3,940,598 * 2/1976 Sekiguchi ..... 235/151.1
4,033,165 * 7/1977 Arimura et al. ..... 72/205
4,537,057 * 8/1985 Kajiwara et al. ..... 72/241.4
4,576,029 * 3/1986 Miyake et al. ..... 72/205
5,161,400 * 11/1992 Lefor ..... 72/205

FOREIGN PATENT DOCUMENTS 60-49802 3/1985 (JP) .
62-38705 * 2/1987 (JP) ..... 72/12.3
6-210307 8/1994 (JP) .
8-33905 2/1996 (JP) .
776677 * 1/1980 (SU) ..... 72/205
1194519 * 11/1985 (SU) ..... 72/205
1421780 * 9/1988 (SU) ..... 72/205
1685562 * 10/1991 (SU) ..... 72/205

* cited by examiner

*Primary Examiner*—Ed Tolan
(74) *Attorney, Agent, or Firm*—Kenyon & Kenyon

(57) ABSTRACT

The present invention is to provide a tandem cold rolling method conducted by a tandem cold rolling mill, the number of rolling stands of which is not less than 4, wherein a rolling tension, the intensity of which is not lower than 30%, preferably not lower than 40% of the deformation resistance of material to be rolled, is given at least by the final rolling stand. The present invention is also to provide a tandem cold rolling mill satisfying the inequality of $J_C \geqq (0.375\bar{h}+0.275) J_M$, wherein the average thickness of a product sheet on the delivery side of the final rolling mill is $\bar{h}$, and an output of one coiler arranged on the delivery side of the tandem cold rolling mill, or a sum of an output of one coiler on the delivery side and an output of the bridle roller on the delivery side is $J_C$, and an output of the main motor of the final rolling stand of the tandem cold rolling mill is $J_M$.

2 Claims, 9 Drawing Sheets

COLD TANDEM ROLLING METHOD AND COLD TANDEM ROLLING MILL

TECHNICAL FIELD

The present invention relates to a tandem cold rolling method and a tandem cold rolling mill thereof, the number of cold rolling stands of which is not less than 4, by which the occurrence of heat scratches is prevented and the productivity is enhanced so that the production cost can be decreased.

BACKGROUND ART

When the work roll speed is increased or the ratio of reduction is increased in a tandem cold rolling mill, heat scratches are caused on the surface of a cold-rolled sheet. A heat scratch is defined as a defect of seizing caused by metallic contact of a work roll with a sheet to be rolled when the temperature of an interface between the work roll and the sheet to be rolled is raised in a rolling bite and an oil film is broken.

When heat scratches occur on the surface of a product, the product becomes defective, and the product yield is lowered. Further, the work rolls of a cold rolling stand in which the heat scratches occur must be changed. Accordingly, the productivity of the cold rolling mill is remarkably deteriorated, which is a serious problem.

Accordingly, concerning the prevention of heat scratches, the following methods have been disclosed. For example, Japanese Unexamined Patent Publication No. 5-98283 discloses a method in which a rolling lubricant having a high anti-seizing property is used. Japanese Unexamined Patent Publication No. 56-111505 discloses a method in which a quantity of coolant is controlled so as to lower the temperatures of cold-rolled sheets and work rolls. Japanese Unexamined Patent Publication No. 6-63624 discloses a method in which the work roll speed is lowered. All of the methods relate to a technique for preventing an increase in the temperature of the interface between the work roll and the sheet to be rolled in the work roll bite and also relates to a technique for preventing a break in an oil film even when the temperature of the interface in the work roll bite is raised. However, even if the above methods are adopted the following problems may be encountered. When a rolling lubricant, the anti-seizing property of which is high, is used, there is a possibility that the production cost is raised. When the temperatures of cold-rolled sheets and work rolls are controlled by controlling a quantity of coolant, it is possible to provide an effect, however, the responding property is not so high, and further the productivity of cold rolling is deteriorated since the work roll speed is decreased.

Japanese Unexamined Patent Publication No. 60-49802 discloses a method to change a reduction schedule and tension, by which the occurrence of heat scratches can be prevented without deteriorating the productivity and increasing the production cost. However, an amount of control to be conducted by the above method is limited by the restriction placed on the apparatus of the cold rolling mill.

Fluctuation in the width of a cold-rolled sheet in the process of cold rolling is smaller than that of a hot-rolled sheet in the process of hot rolling. Therefore, conventionally, sheet width control is seldom conducted in the process of cold rolling unlike the process of hot rolling in which width gauges are arranged on the entry and the delivery side of the hot rolling mill and tension is controlled in accordance with the results of measurement of the width of a sheet measured by the width gauges.

CONSTRUCTION OF THE INVENTION

As described above, the effect provided by the conventional tandem cold rolling method is limited. The reasons are described as follows. According to the method by which the occurrence of scratches is prevented without deteriorating the productivity and raising the production cost, there is a possibility that the accuracy of sheet thickness is temporarily deteriorated in the case of changing the reduction schedule. According to the method by which the tension given to the sheet is changed, since the rolling pressure is decreased and the generation of heat caused by friction is decreased by increasing the tension, it is possible to prevent the occurrence of heat scratches. However, when the tension is increased in order to enhance the effect of prevention of heat scratches, the sheet to be rolled tends to break. According to the tandem cold rolling mill of the prior art, heat scratches tend to occur in the cold rolling stands in the latter stage, and further it is impossible to increase a tension between the rolling stands for the reasons of the restriction placed on the apparatus. Accordingly, in a rolling stand in the latter stage, an intensity of tension given to the sheet on the entry side tends to be higher than an intensity of tension on the delivery side. Therefore, slipping between the sheet to be rolled and the work roll, and chattering, tend to occur in the rolling stand in the latter stage, which causes another problem. According to a method by which tension is controlled in accordance with the sheet temperature that has been detected on the delivery side of the rolling stand, control is conducted when the temperature has risen to a value at which heat scratches occur. For this reason, there is a possibility that heat scratches occur temporarily.

Further, when the intensity of tension given to the sheet is increased, the fluctuation of sheet width is increased, which deteriorates the accuracy of sheet width. Therefore, according to the conventional method, the prevention of heat scratches is incompatible with the enhancement of economy and productivity.

The present invention has been achieved to solve the above problems of the conventional method. The summary of the present invention will be described as follows:

(1) A tandem cold rolling method of cold-rolling a sheet by a tandem cold rolling mill, the number of rolling stands of which is not less than 4, comprising the step of conducting rolling at least in the final rolling stand while a rolling tension, the intensity of which is not less than 30% of the deformation resistance of the sheet to be rolled, is given to the sheet.

(2) A tandem cold rolling method of cold-rolling a sheet by a tandem cold rolling mill, the number of rolling stands of which is not less than 4, having a coiler on the delivery side, or a coiler and a bridle roller, or a coiler and a pinch roller, comprising the step of conducting rolling at least in the final rolling stand while a rolling tension, the intensity of which is not less than 30% of the deformation resistance of the sheet to be rolled, is given to the sheet, while an average thickness ($\bar{h}$) of a cold-rolled sheet to be produced by the tandem cold rolling mill, an output of the main motor of the coiler arranged on the delivery side, and/or an output of the main motor of the bridle roller, and/or an output of the main motor of the pinch roller, and an output of the main motor of the final rolling stand of the tandem cold rolling mill, are adjusted.

(3) A tandem cold rolling mill comprising: cold rolling stands, the number of which is not less than 4; and a coiler, or a coiler and a bridle roller, or a coiler and a pinch roller arranged on the delivery side of the tandem cold rolling mill, wherein the inequality of $J_C \geqq (0.375\bar{h}+0.275)J_M$ is satisfied, wherein the average thickness of a product to be produced by the tandem cold rolling mill is $\bar{h}$, and an output of the main motor of one coiler arranged on the delivery side of the tandem cold rolling mill, or a sum of an output of the main motor of one coiler on the delivery side and an output of the main motor of the bridle roller on the delivery side, or a sum of an output of the main motor of one coiler on the delivery side and an output of the main motor of the pinch roller, is $J_C$, and an output of the main motor of the final rolling stand of the tandem cold rolling mill is $J_M$.

(4) A rolling method of rolling a cold-rolled sheet by a tandem cold rolling mill, in the rolling stand of which heat scratches tend to occur, comprising the steps of: detecting or calculating a sheet temperature on the delivery side of the rolling stand, a rolling load, a work roll speed, a sheet speed on the delivery side of the rolling stand, sheet thickness on the entry and the delivery side of the rolling stand, and tensions on the entry and the delivery side of the rolling stand; estimating a sheet temperature $T_f$ on the delivery side of the rolling stand in a steady condition or a rolling condition at the successive tension control time by the sheet temperature detected on the delivery side of the rolling stand; finding a temperature increase $T_E'$ on an interface between the work roll and the sheet at the exit of the roll bite of the rolling stand and also finding a temperature increase $T_m'$ on an interface between the work roll and the sheet at the exit of the roll bite of the rolling stand in the case where the tension is changed, using the detected and calculated values of the sheet temperature on the delivery side of the rolling stand, the rolling load, the work roll speed, the sheet speed on the delivery side of the rolling stand, the thickness on the entry and the delivery side of the rolling stand, and the tensions on the entry and the delivery side of the rolling stand, and also using the coefficient of friction and the deformation resistance found by the detected and the calculated values, when the estimated sheet temperature exceeds a predetermined heat scratch control target temperature $T_L$; finding a tension satisfying an inequality of $T_L-T_f \geqq T_m'-T_E'$; controlling a tension of the rolling stand in accordance with the thus found tension;

and rolling the sheet while a rolling tension, the intensity of which is not less than 30% of the deformation resistance of the sheet to be rolled, is given to the sheet.

(5) A rolling method of rolling a cold-rolled sheet by a tandem cold rolling mill, in the rolling stand of which heat scratches tend to occur, comprising the steps of: detecting or calculating a sheet temperature on the delivery side of the rolling stand, a rolling load, a work roll speed, a sheet speed on the delivery side of the rolling stand, sheet thickness on the entry and the delivery side of the rolling stand, and tensions on the entry and the delivery side of the rolling stand; estimating a sheet temperature $T_f$ on the delivery side of the rolling stand in a steady condition or a rolling condition at the successive tension control time by the sheet temperature detected on the delivery side of the rolling stand; finding a temperature increase $T_E'$ on an interface between the work roll and the sheet at the exit of the roll bite of the rolling stand and also finding a temperature increase $T_m'$ on an interface between the work roll and the sheet at the exit of the roll bite of the rolling stand in the case where the tension is changed, using the detected and calculated values of the sheet temperature on the delivery side of the rolling stand, the rolling load, the work roll speed, the sheet speed on the delivery side of the rolling stand, the thickness on the entry and the delivery side of the rolling stand, and the tensions on the entry and the delivery side of the rolling stand, and also using the coefficient of friction and the deformation resistance found by the detected and the calculated values, when the estimated sheet temperature exceeds a predetermined heat scratch control target temperature $T_L$; finding a tension satisfying an inequality of $T_L-T_f \geqq T_m'-T_E'$; setting the tension to be a value not higher than the maximum tension $\sigma_{bmax}$ on the entry side of the rolling stand or the maximum tension $\sigma_{fmax}$ on the delivery side of the rolling stand at which the sheet is not broken, in the case where the tension exceeds the maximum tension $\sigma_{bmax}$ on the entry side of the rolling stand or the maximum tension $\sigma_{fmax}$ on the delivery side of the rolling stand; finding a temperature increase $T_m''$ on an interface between the sheet and the work roll at the exit of the roll bite of the rolling stand when the work roll speed is changed in the thus set tension condition; finding a work roll speed satisfying an inequality of $T_L-T_f \geqq T_m''-T_E'$; controlling a work roll speed of the rolling stand in accordance with the thus found work roll speed; and rolling the sheet while a rolling tension, the intensity of which is not less than 30% of the deformation resistance of the sheet to be rolled is given to the sheet.

(6) A rolling method of rolling a cold-rolled sheet by a tandem cold rolling mill, the number of the rolling stands of which is not less than 4, each rolling stand having a profile control unit, comprising the steps of: measuring sheet widths on the entry and the delivery side of the tandem mill; calculating changes in the sheet widths on the entry and the delivery side of the tandem mill by the measured sheet widths; controlling the profile control unit so that the changes in the sheet widths cannot exceed a predetermined allowable value; and rolling the sheet while a tension, the intensity of which is not less than 30% of the deformation resistance of the sheet to be rolled, is given to the sheet at least in the final rolling stand.

(7) A rolling method of rolling a cold-rolled sheet by a tandem cold rolling mill, the number of the rolling stands of which is not less than 4, each rolling stand having a profile control unit, comprising the steps of: virtually dividing all rolling stands of the tandem cold rolling mill into a plurality of independent tandem cold rolling mills so that each divided tandem cold rolling mill composes an independent tandem cold rolling mill; measuring sheet widths on the entry and the delivery side of each independent tandem mill; calculating changes in the sheet widths on the entry and the delivery side of the tandem cold rolling mill by the measured sheet widths; controlling the profile control units of all tandem cold rolling mills so that the changes in the sheet widths cannot exceed a predetermined allowable value; and rolling the sheet while a tension, the intensity of which is not less than 30% of the deformation resistance of the sheet to be rolled, is given to the sheet at least in the final rolling stand.

BRIEF DESCRIPTION OF THE DRAWINGS

FIG. 8(*b*) is a graph showing a relation between the number of rolled coils and the tension on the entry side.

FIG. 9(*b*) is a graph showing a relation between the number of rolled coils and the speed of a work roll according to the method of the present invention.

BEST MODE FOR CARRYING OUT THE INVENTION

The more the rolling speed is increased, the more the quantity of rolling lubricant introduced into the roll bite is increased, so that the coefficient of friction is decreased. Accordingly, a forward slip rato, which is defined by the sheet speed on the delivery side and the work roll speed, is decreased. The more the tension on the entry side is increased, compared to the tension on the delivery side, the less the forward slip ratio is decreased. Consequently, there is a tendency that the more the rolling speed is increased and the more the tension on the entry side is increased, the less the forward slip ratio is decreased. In this connection, depending upon the type of steel and the reduction schedule, when the forward slip ratio is decreased to a value not higher than a limit, slipping and chattering occur on a rolled sheet. In accordance with the occurrence of slipping, a relative slip speed between the work roll and the sheet to be rolled in the roll bite is suddenly increased. Therefore, an amount of heat generated by friction is suddenly increased and heat scratches occur. When chattering occurs on the rolled sheet, the thickness of the portion concerned deviates from the standard and, further, chattering marks occur on the surface of the sheet, so that the surface quality is deteriorated. Consequently, in order to prevent the occurrence of slipping and chattering, it is necessary to increase the forward slip ratio to more than the limit described above. For this reason, the intensity of tension on the delivery side must be increased in accordance with the intensity of tension on the entry side.

Figure 1:
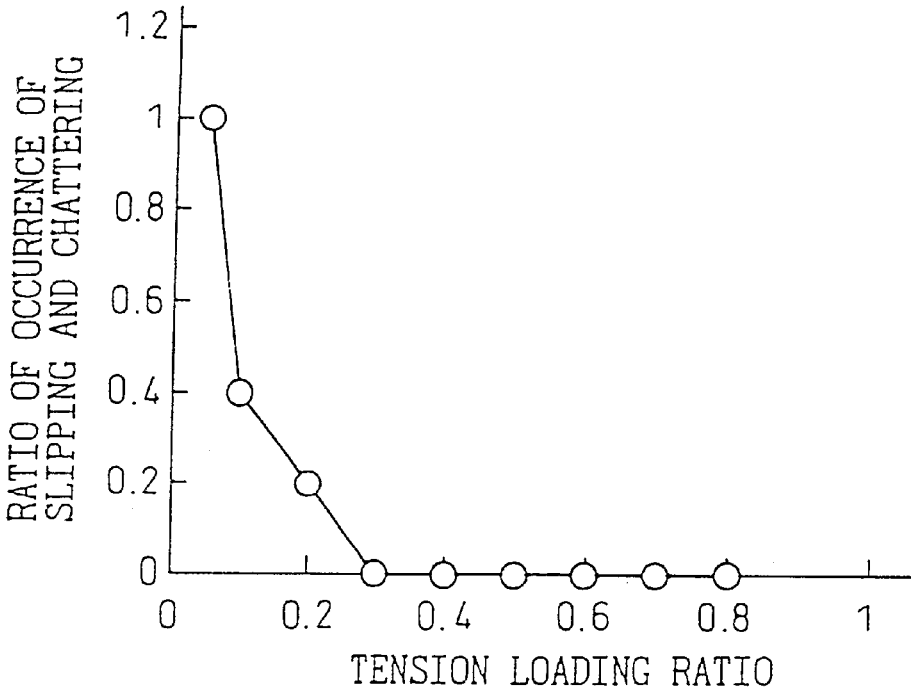
FIG. 1 is a graph showing a relation between a ratio of occurrence of slipping and chattering, and a ratio of tension load.

FIG. 1 is a graph showing a relation between a ratio of occurrence of chattering and slipping, and a tension loading ratio obtained in an experiment in which the tension was changed in a wide range, wherein the ratio of occurrence of chattering and slipping is 1 when the tension loading ratio $\kappa=0.05$. In this case, $\kappa$ is a tension loading ratio, which is an index to express a level of tension on the entry and delivery side of a rolling stand. This index is expressed by (tension)/(deformation resistance of a sheet to be rolled). When the tension loading ratio on the entry side of a rolling stand is $\kappa_b$ and the tension loading ratio on the delivery side of a rolling stand is $\kappa_f$, the tension $\sigma_b$ on the entry side of the rolling stand is expressed by $\sigma_b=\kappa_b\ \sigma_{yi}$, and the tension $\sigma_f$ on the delivery side of the rolling stand is expressed by $\sigma_f=\kappa_f\ \sigma_{yo}$, wherein $\sigma_{yi}$ is a yield stress of 0.2% of the sheet to be rolled on the entry side of the rolling stand, and $\sigma_{yo}$ is a yield stress of 0.2% of the sheet to be rolled on the delivery side of the rolling stand. In this connection, the tension loading ratio or $\kappa$ includes both the tension loading ratio $\kappa_b$ on the entry side of a rolling stand and the tension loading ratio $\kappa_f$ on the delivery side of a rolling stand, in this specification, hereinafter.

As can be seen in FIG. 1, in order to realize a stable rolling operation in which no chattering and slipping occur, the tension loading ratio $\kappa$ must be not less than 0.3.

Figure 2:
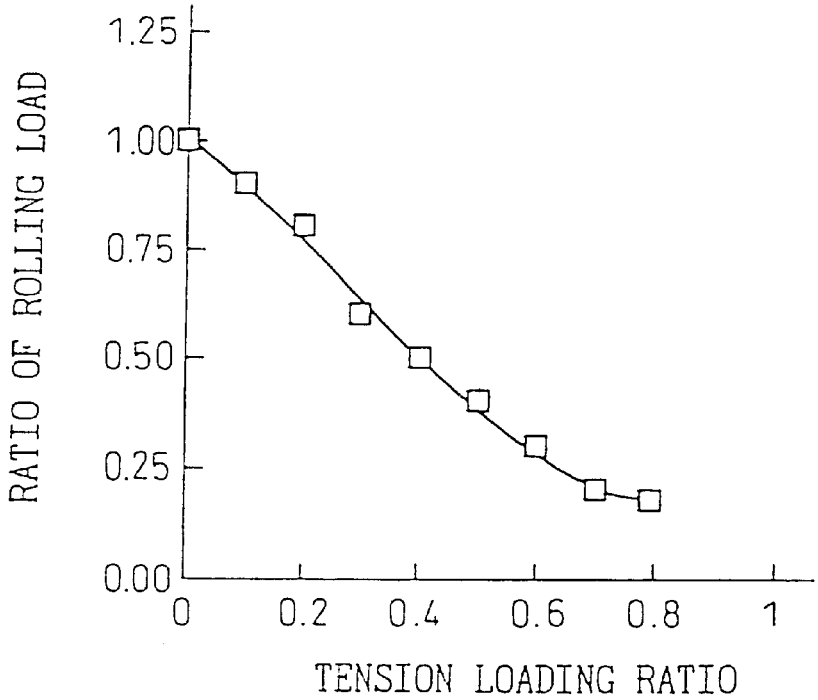
FIG. 2 is a graph showing a relation between a ratio of rolling load and a tension loading ratio.
Figure 3:
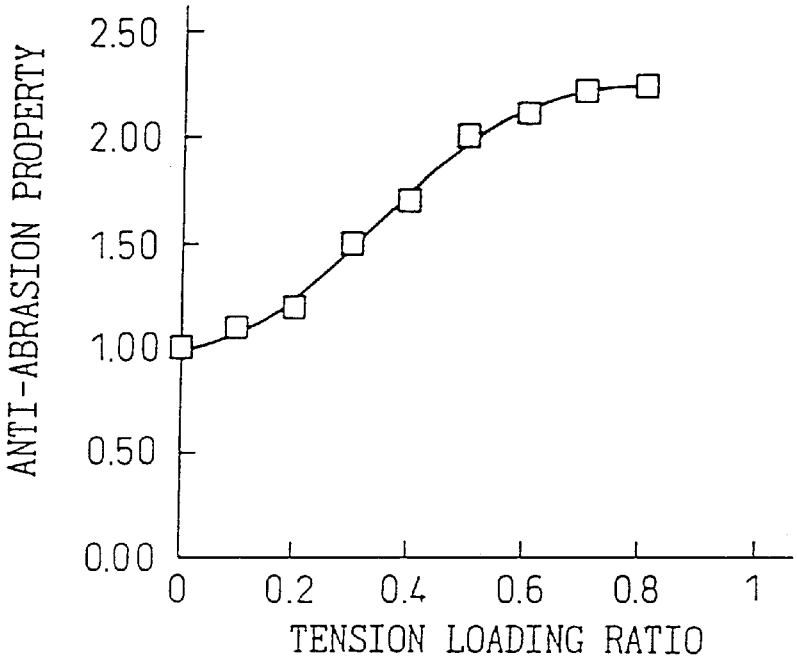
FIG. 3 is a graph showing a relation between an anti-abrasion property and a tension loading ratio.

FIG. 2 is a graph showing a relation between a ratio of rolling load and a tension loading ratio $\kappa$, which was found in an experiment in which the tension loading ratio was changed, wherein the rolling load was set at 1 when rolling was conducted under the condition of no tension ($\kappa=0$). FIG. 3 is a graph showing a relation between an amount of abrasion of the work roll and a tension loading ratio $\kappa$, wherein the amount of abrasion of the work roll was obtained when a weight of the work roll after it had been rotated by 100,000 revolutions while rolling load and slipping were given to the work roll, was subtracted from a weight of the work roll before the experiment, and an amount of abrasion in the case of rolling conducted under the condition of no tension was defined as 1.

As can be seen in FIGS. 2 and 3, the more the tension loading ratio $\kappa$ is increased, the less the pressure and contact length in the roll bite is decreased. Therefore, it has been made clear that the tension loading ratio greatly affects the ratio of rolling load and the anti-abrasion property.

Figure 4:
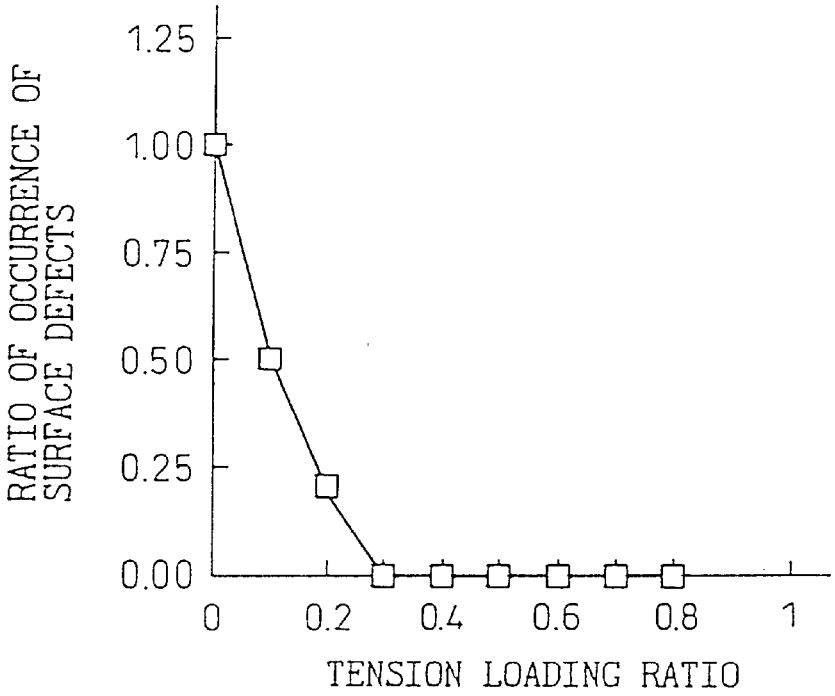
FIG. 4 is a graph showing a relation between a ratio of occurrence of surface defects and a tension loading ratio.

FIG. 4 is a graph showing a relation between a ratio of occurrence of surface defects and a tension loading ratio $\kappa$ to load. In this case, the surface defect is defined as heat scratches, chattering, and surface defects caused when foreign objects get between the sheet and the work roll or between the work roll and the intermediate roller, and a ratio of occurrence of surface defects is set at 1 when rolling is conducted under the condition of no tension ($\kappa=0$). As can be seen in FIG. 4, when the tension loading ratio $\kappa$ was increased, the ratio of occurrence of surface defects was decreased, and when the tension loading ratio $\kappa$ exceeded 0.3, no surface defects occurred.

As described above, the tension loading ratio $\kappa$ is set at a value not less than 0.3, and it is preferable that the tension loading ratio $\kappa$ is set at a value not less than 0.4. That is, a tension, the intensity of which is not less than 30% of the deformation resistance of the sheet to be rolled, is given on the entry side and the delivery side of the rolling stand concerned, and it is preferable that a tension, the intensity of which is not less than 40% of the deformation resistance of the sheet to be rolled, is given on the entry side and the delivery side of the rolling stand concerned. Due to the foregoing, it is possible to conduct rolling without causing heat scratches, chattering and slipping, and also it is possible to decrease a rolling load, so that the surface roughness of the work roll can be maintained over a long period of time and the anti-abrasion property can be ensured. In this connection, when the tension loading ratio $\kappa$ exceeds 0.7, the effects of decreasing the rolling load and enhancing the anti-abrasion property are saturated, and further there is a possibility that the sheet to be rolled is broken in the case where minute cracks are caused at the sheet edges in the width direction. Accordingly, it is preferable that the upper limit of the tension loading ratio is set at 0.7.

The tension loading ratio may be set in all rolling stands in the way described above. However, the tension loading ratio may be set in the way described above only in the rolling stands in which heat scratches, slipping and chattering tend to occur. Since heat scratches, slipping and chattering tend to occur in the final rolling stand, the rolling speed of which is the highest, the tension loading ratio κ is set at a value not lower than 0.3 at least in the final rolling stand, and it is preferable that the tension loading ratio κ is set at a value not lower than 0.4 at least in the final rolling stand.

Next, an explanation will be made for a tandem cold rolling mill to realize the rolling method described above. When cold rolling is conducted by a conventional tandem cold rolling mill at a common rolling speed (1000 to 2000 m/min), since an output of the primary motor of one coiler arranged on the delivery side of the final rolling stand is low, it is impossible to increase an intensity of tension of the sheet to be rolled on the delivery side of the final rolling stand. At present, in a tandem cold rolling mill used for rolling thick cold-rolled sheets, the thickness $\bar{h}$ of which is not less than 0.6 mm and the amount of production of which exceeds 50% of the overall production, an output of one coiler arranged on the delivery side of the final rolling stand is not higher than 47% of the main motor of the final rolling stand, and a sum of the output of one coiler arranged on the delivery side of the final rolling stand and the output of the main motor of the bridle roller on the delivery side is not higher than 47% of the main motor of the final rolling stand, and a sum of the output of one coiler arranged on the delivery side of the final rolling stand and the output of the main motor of the pinch roller on the delivery side is not higher than 47% of the main motor of the final rolling stand. At present, in a tandem cold rolling mill used for rolling thin cold-rolled sheets, the thickness $\bar{h}$ of which. is smaller than 0.6 mm and the amount of production of which exceeds 50% of the overall production, the aforementioned output is not higher than 32% of the main motor of the final rolling stand. Accordingly, in the case of rolling low carbon steel, an intensity of tension given to the sheet on the delivery side of the final rolling stand is usually 5 to 10 kgf/mm$^2$. In the case of rolling low carbon steel, due to the work hardening caused by cold rolling, the deformation resistance of a cold-rolled sheet is 60 to 70 kgf/mm$^2$ on the delivery side of the final rolling stand. Accordingly, an intensity of tension given to the sheet by the coiler is about 7 to 17% of the deformation resistance of the sheet. Since the intensity of the tension on the delivery side of the final rolling stand is low as described above, an intensity of tension given to the sheet on the entry side of the final rolling stand is necessarily kept at a low value from the viewpoint of preventing slipping and chattering. Since the intensity of the tension on the entry side of the final rolling stand is the same as the intensity of the tension on the delivery side of the rolling stand arranged immediately before the final rolling stand, an intensity of the tension on the entry side of the rolling stand arranged immediately before the final rolling stand is low. Also, an intensity of the tension of the rolling stand upstream is low. For the above reasons, in the conventional tandem cold rolling mill, an intensity of the rolling tension is about 20% of the deformation resistance of the sheet to be rolled at the highest.

The maximum tension on the delivery side of the final rolling stand is in inverse proportion to the sheet thickness, the sheet width and the sheet speed of the final rolling stand. The maximum tension on the delivery side of the final rolling stand is in proportion to an output of the main motor of the coiler, or a sum of the output of the main motor of the coiler and the output of the main motor of the bridle roller, or a sum of the output of the main motor of the coiler and the output of the main motor of the pinch roller. In this case, the output of the main motor is the maximum output of the main motor. Consequently, there is a tendency that the higher the rolling speed is increased, the lower the maximum tension is decreased. In other words, when the rolling speed is high, it is impossible to increase the tension loading ratio.

Accordingly, as a means for increasing the tension loading ratio in the case of rolling at high speed, it is necessary to adopt a means in which an output of the main motor of the coiler is increased, that is, the main motor of the coiler is replaced with another one, the maximum output of which is high, or alternatively, it is necessary to install bridle rollers or pinch rollers.

Accordingly, in order to increase the tension loading ratio κ at the final rolling stand to be a value not lower than 0.3 or preferably not lower than 0.4, it is necessary to optimize the output of the main motor of the final rolling stand and the output of the main motor of the coiler system. Alternatively, it is necessary to optimize the output of the main motor of the final rolling stand and a sum of the output of the main motor of the coiler and the output of the bridle roller. Alternatively, it is necessary to optimize the output of the main motor of the final rolling stand and a sum of the output of the main motor of the coiler and the output of the pinch roller. In order to optimize the output as described above, it is necessary to find the work conducted by the rolling mill and the coiler. Alternatively, it is necessary to find the work conducted by the rolling mill and the coiler and the bridle roller. Alternatively, it is necessary to find the work conducted by the rolling mill and the coiler and the pinch roller.

First, in order to find the work conducted by the rolling mill; a rolling load, a rolling torque and a forward slip ratio are found. For example, it is possible to find the rolling load P by Hill's equation (1) as shown below.

$$P = W[K_m - (0.7\sigma_b + 0.3\sigma_f)]\sqrt{R'(H-h)} \times \left[1.08 + 1.79r\sqrt{1-r}\,\mu\sqrt{R'/h} - 1.02r\right] \quad (1)$$

In the above equation, W is a width, $K_m$ is a deformation resistance, $\sigma_b$ is a tension on the entry side, $\sigma_f$ is a tension on the delivery side, R' is a radius of the work roll after it has been flattened, H is a sheet thickness on the entry side of the rolling mill, h is a sheet thickness on the delivery side of the rolling mill, r is a ratio of reduction, and $\mu$ is a coefficient of friction.

In this connection, deformation resistance $K_m$ is expressed by the equation (2) in which constants a, $\epsilon_0$ and n, which have been previously found by the result of tensile test, are used. In this connection, Hs is a thickness of the material to be rolled, that is, Hs is a thickness of the sheet on the entry side of the first rolling stand, and $\epsilon$ is a strain.

$$\left.\begin{aligned}&\sigma_y(\varepsilon) = a(\varepsilon + \varepsilon_o)^n\\&\varepsilon = -\ln(h/H_s)\\&\varepsilon_m = 0.4\varepsilon_b + 0.6\varepsilon_f\\&\varepsilon_f = -\ln(h/H_s),\quad \varepsilon_b = -\ln(H/H_s)\\&K_m = 2\big/\sqrt{3}\,\sigma_y(\varepsilon_m)\end{aligned}\right\} \tag{2}$$

Next, the rolling torque T, which is a sum of the rolling torque of the upper roll and the rolling torque of the lower roll, is expressed by the equation (3) when Hill's Equation is used. The forward slip ratio $f_s$ is expressed by the equation (4) when Bland & Ford's Equation is used. The radius R' of the roll in the equations (1), (3) and (4) after the roll has been flattened can be found by the equation (5) of Hitchcoock's Equation when it is combined with the equation (1). In this connection, in the equation (5), E is Young's modulus, ν is the Poisson's ratio, and π is the circular constant.

$$\left.\begin{aligned}&T = T_o + RW(H\sigma_b - h\sigma_f)\\&T_o = WK_m\cdot(1 - 0.9\sigma_b - 0.1\sigma_f)R(H-h)D_G\\&D_G = 1.05 + (0.07 + 1.32r)\sqrt{1-r}\,\mu\sqrt{R'/h} - 0.85r\end{aligned}\right\} \tag{3}$$

$$\left.\begin{aligned}&f_s = \phi_n^2\{\tan(\sqrt{h\cdot R'}\ H_n/2)\}^2\\&H_n = \sqrt{R'/h}\tan^{-1}\left(\sqrt{(H-h)/h}\right) - \frac{1}{2\mu}\ln\left[\frac{H}{h}\frac{K_m-\sigma_f}{K_m-\sigma_b}\right]\end{aligned}\right\} \tag{4}$$

$$R' = R\left[1 + \frac{16(1-\nu^2)}{W\pi E}\frac{P}{H-h}\right] \tag{5}$$

Work $J_M$ conducted by the rolling mill in the unit time is expressed by the equation (6) in which the rolling torque T, which is a sum of the upper roll torque and the lower roll torque, and the forwards slip ratio $f_s$ are used. In this connection, R is a radius of the roll, and $V_0$ is a sheet speed on the delivery side of the rolling stand.

$$J_M = T\,V_o/\{R(1+f_s)\} \tag{6}$$

As described above, work $J_M$ conducted by the rolling mill in the unit time can be simply found. As can be seen in FIG. (3), work $J_M$ conducted by the rolling mill in the unit time is composed of the work generated in the roll bite and the work generated by the tension before and after the rolling stand. When the tension on the entry side of the rolling stand is made to be the same as the tension on the delivery side of the rolling stand, no work is generated by the tension before and after the rolling mill. Accordingly, when consideration is given to the overall tandem cold rolling mill, it is preferable that the tension on the entry side of the rolling mill is the same as the tension on the delivery side of the rolling mill, that is, it is preferable that $H\sigma_b = h\sigma_f$.

The work $J_C$ conducted by the coiler, or the coiler and the bridle roller, or the coiler and the pinch roller, is expressed by the equation (7).

$$J_c = V_o\kappa\sigma_y h\,W \tag{7}$$

As can be seen in the equation (7), it is clear that the higher the tension loading ratio κ is, the more the work conducted by the coiler is increased.

Using the above equations, a ratio of the work $J_C$ conducted by the coiler to the work $J_M$ conducted by the rolling mill in the unit time is compared as follows.

Table 1 shows the typical results of calculation. In Table 1, the following two rolling conditions at the final rolling stand are estimated. One is a rolling condition at the final rolling stand by which a thin sheet is rolled, the thickness of which is smaller than 0.6 mm, and the other is a rolling condition at the final rolling stand by which a thick sheet is rolled, the thickness of which is not smaller than 0.6 mm. However, concerning the constants in the equation (2) that expresses the deformation resistance, values previously obtained by a tensile test were used, that is, a=67 kgf/mm$^2$, $\epsilon_0$=0.03, and n=0.2. Concerning the coefficient of friction, the typical coefficient of friction $\mu$=0.05, which was obtained at the final rolling stand in the normal rolling condition, was used.

In this connection, the radius of the roll shown on Table 1 is the typical radius of the roll used for the final rolling stand of the tandem cold rolling mill. Concerning the ratio of reduction, the speed of the work roll and the thickness of the sheet, values of the typical rolling condition adopted in the usual rolling operation of a tandem cold rolling mill were used.

TABLE 1

| | | | | | | | a Ratio of work $J_c$ conducted by the coiler system in the unit time, to work $J_M$ conducted by the final rolling stand in the unit time | | | | |
|---|---|---|---|---|---|---|---|---|---|---|---|
| | R | h | r | P | $V_R$ | $H_S$ | $J_c/J_M$ | | | | |
| No | (mm) | (mm) | (%) | (tf/m) | (m/min) | (mm) | κ = 0.2 | κ = 0.3 | κ = 0.4 | κ = 0.5 | κ = 0.6 |
| 1 | 200 | 0.2 | 20 | 952 | 2000 | 3.0 | 0.438 | 0.657 | 0.876 | 1.094 | 1.313 |
| 2 | 200 | 0.2 | 30 | 1222 | 2000 | 3.0 | 0.248 | 0.371 | 0.495 | 0.619 | 0.743 |
| 3 | 250 | 0.2 | 20 | 1147 | 2000 | 2.3 | 0.400 | 0.600 | 0.800 | 1.000 | 1.200 |
| 4 | 250 | 0.2 | 30 | 1515 | 2000 | 2.3 | 0.233 | 0.344 | 0.455 | 0.586 | 0.668 |
| 5 | 200 | 0.6 | 20 | 788 | 2000 | 3.0 | 0.694 | 1.041 | 1.388 | 1.736 | 2.082 |
| 6 | 200 | 0.6 | 30 | 957 | 2000 | 3.0 | 0.414 | 0.621 | 0.828 | 1.035 | 1.242 |
| 7 | 250 | 0.6 | 20 | 973 | 2000 | 3.0 | 0.665 | 0.997 | 1.330 | 1.662 | 1.995 |
| 8 | 250 | 0.6 | 30 | 1185 | 2000 | 3.0 | 0.315 | 0.498 | 0.780 | 0.917 | 1.104 |

Under the above conditions, the following two rolling conditions at the final rolling stand were estimated. One is a rolling condition at the final rolling stand by which a thin sheet is rolled, the thickness of which is smaller than 0.6 mm, and the other is a rolling condition at the final rolling stand by which a thick sheet is rolled, the thickness of which is not smaller than 0.6 mm. Work conducted by the coiler system in the unit time and work conducted by the rolling mill were calculated and compared with each other when a tension loading ratio was changed.

When comparison is made under the same rolling conditions of the thickness h of the sheet on the delivery side and the tension loading ratio κ, it can be concluded that the higher the ratio r of reduction is increased, the more the work. $J_M$ conducted by the rolling mill in the unit time is increased. Also, it can be concluded that the larger the radius R of the roll is, the more the work $J_M$ conducted by the rolling mill in the unit time is increased. Accordingly, a ratio of the work $J_C$ conducted by the coiler system in the unit time to the work $J_M$ conducted by the rolling mill in the unit time is decreased. When the tension loading ratio is increased, a ratio of work conducted by the coiler system is increased. Accordingly, the ratio of the work $J_C$ conducted by the coiler system in the unit time to the work $J_M$ conducted by the rolling mill in the unit time is increased.

In this connection, an amount of work conducted in the final rolling stand is restricted by an output of the motor of the final rolling stand, and an amount of work conducted by the coiler is determined while consideration is given to the amount of work conducted in the final rolling stand. In the present invention, the ratio of the work conducted by the final rolling stand to the work conducted by the coiler system must be determined while consideration is given to the tension loading ratio κ. Accordingly, the amount of work conducted by the coiler system must be determined while consideration is given to the amount of work conducted by the final rolling stand in accordance with the rolling condition such as a roll speed, roll diameter and ratio of reduction. As can be seen in the equations (1) to (6), the higher the ratio of reduction is increased, the more the amount of work of the final rolling stand is increased, and also the larger the roll diameter is increased, the more the amount of work of the final rolling stand is increased. For the reasons described above, it is preferable that the capacity of the coiler system is investigated in accordance with an amount of work described in items No. 4 and No. 8 on Table 1 in which the radius of the roll is 250 mm and the ratio of reduction is not lower than 30%.

Due to the foregoing, the following can be concluded. In order to make investigation into an advantageous rolling mill to carry out the method of the present invention, that is, in order to display its capacity sufficiently, it is necessary to determine the minimum amount of work to be conducted by the coiler with respect to the maximum amount of work to be conducted by the final rolling stand. Since the maximum amount of work to be conducted by the final rolling stand is determined by the output (the maximum output) of the main motor of the final rolling stand, the minimum amount of work to be conducted by the coiler system is determined by the output (the minimum output) of the main motor of the coiler system in the same manner. Accordingly, as shown by the above rolling conditions, when the ratio of the work $J_C$ conducted by the coiler system in the unit time to the work $J_M$ conducted by the rolling mill in the unit time is found, the minimum output necessary for the main motor of the coiler system can be simply found by the maximum output of the primary motor of the rolling mill.

In this connection, as described before, in order to conduct tandem cold rolling stably, it is necessary that the tension loading ratio κ is not lower than 0.3. As can be seen on Table 1, in order to make the tension loading ratio κ to be higher than 0.3, the amount of work conducted by the coiler system must be not less than 50% of the amount of work conducted by the final rolling stand in the case of a tandem cold rolling mill for producing a product, the thickness of which is 0.6 mm. Also, in order to make the tension loading ratio κ higher than 0.3, the amount of work conducted by the coiler system must be not less than 35% of the amount of work conducted by the final rolling stand in the case of a tandem cold rolling mill for producing a product, the thickness of which is 0.2 mm. That is, the output of the main motor of the coiler system must be not lower than 50% of the main motor of the final rolling stand in the case of a tandem cold rolling mill for producing a product, the thickness of which is 0.6 mm. Also, the output of the main motor of the coiler system must be not lower than 35% of the main motor of the final rolling stand in the case of a tandem cold rolling mill for producing a product, the thickness of which is 0.2 mm.

In this connection, instead of the arrangement in which a high intensity of tension is generated only by the coiler arranged on the delivery side of the final rolling mill, it is possible to adopt an arrangement in which a bridle roller or a pinch roller for giving tension to the sheet is arranged between the final rolling stand and the coiler on the delivery side, while consideration is given to a change in the coiler. In this case, a sum of the output of one coiler arranged on the delivery side and the output of the bridle roller may satisfy the above conditions, or alternatively a sum of the output of one coiler arranged on the delivery side and the output of the pinch roller may satisfy the above conditions.

Due to the foregoing, the following can be concluded. It is necessary to provide a tandem cold rolling mill in which the inequality of $J_C \geqq (0.375\bar{h}+0.275)J_M$ is satisfied, wherein the average thickness of a product to be produced by the tandem cold rolling mill is $\bar{h}$, and an output of the main motor of one coiler arranged on the delivery side of the tandem cold rolling mill, or a sum of an output of the main motor of one coiler on the delivery side and an output of the main motor of the bridle roller on the delivery side, or a sum of an output of the main motor of one coiler on the delivery side and an output of the main motor of the pinch roller, is $J_C$, and an output of the primary motor of the final rolling stand is $J_M$.

When the overall rolling tension, which is obtained when the rolling tension is multiplied by the sheet thickness and the sheet width, on the entry side of the rolling mill is made to be the same as the overall rolling tension of on the delivery side of the rolling mill as described before, an excessive load including a load caused by a mechanical loss is not given to the rolling mill, and the unit requirement of electric power can be improved. For the above reasons, it is preferable that the overall rolling tension on the entry side is the same as the overall rolling tension on the delivery side.

Next, an explanation will be made for a rolling method conducted in a tandem cold rolling mill in which a speed of the work roll of the rolling stand is controlled according to a rise in the temperature on the interface between the rolled sheet in the roll bite and the roll and also according to the speed of the work roll.

Figure 7:
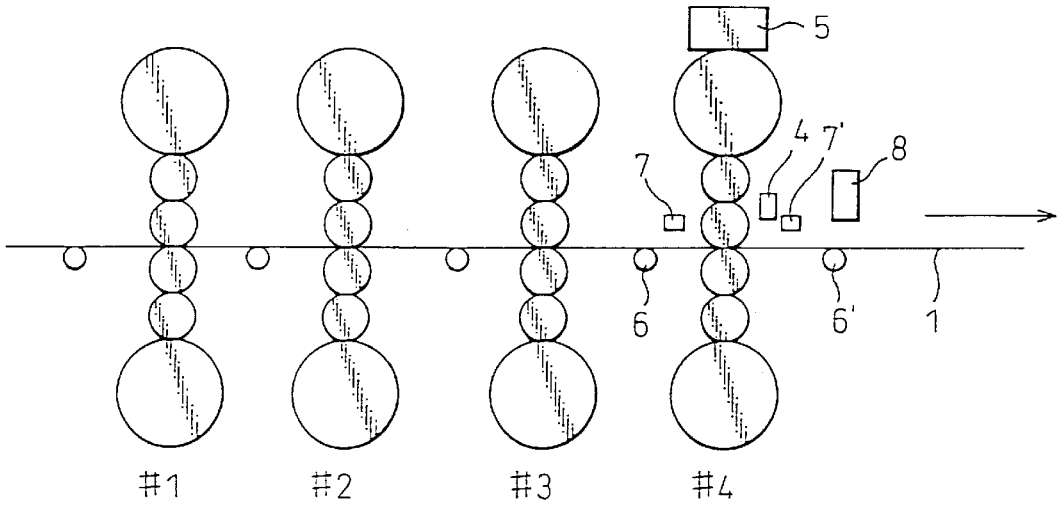
FIG. 7 is an overall arrangement view of the tandem cold rolling mill to which the method of the present invention is applied.

FIG. 7 is an arrangement view of a 4-stand type tandem cold rolling mill. Usually, a tandem cold rolling mill includes 2 to 8 cold rolling stands. In this view showing the present invention, 4 rolling stands are illustrated. A rolling stand in which heat scratches tend to occur depends upon the rolling conditions such as a ratio of reduction, sheet thickness, rolling load, tension, rolled material and lubricating condition. Usually, heat scratches tend to occur in a rolling stand in the last stage, the rolling load and work roll speed of which are increased as compared with a rolling stand in the first stage. In this example, heat scratches tend to occur in the final rolling stand, that is, the fourth rolling stand. In this connection, when there is a Possibility that heat scratches occur in a rolling stand except for the rolling stand in the rear stage, it is also possible to apply the present invention to this rolling stand.

As illustrated in FIG. 7, there is provided a sheet temperature detector (4) on the delivery side of the fourth rolling stand. By this sheet temperature detector (4), temperature T of the sheet to be rolled can be detected at regular intervals. In this connection, it is preferable to use a non-contact type sheet temperature detector (4), for example, a radiation thermometer is preferably used. Rolling load P is detected by a load cell (5). The tension (the force per unit area) $\sigma_b$ on the entry side and the tension $\sigma_f$ on the delivery side of the rolling stand are found in such a manner that the overall tensions detected by load cells (not shown) of deflector rollers (6, 6') arranged on the entry and the delivery side of the rolling stand are subjected to calculation using the sheet thickness and the sheet width. On the entry and the delivery side of the fourth rolling stand, there are provided sheet thickness measuring devices (7, 7'), for example, there are provided X-ray thickness gauges. On the delivery side of the fourth rolling stand, there is provided a sheet speedometer (8), for example, there is provided a laser-beam type sheet speedometer. Sheet thickness H on the entry side and sheet thickness h on the delivery side of the fourth rolling stand are respectively detected by the above sheet thickness gauges, and sheet speed $V_0$ on the delivery side of the fourth rolling stand is detected by the above sheet speedometer. Work roll speed $V_R$ of the fourth rolling stand is found in such a manner that a speed of the motor to drive the work roll is detected by a speed detector (not shown), and calculation is conducted to find the work roll speed using the thus detected motor speed, work roll diameter D and gear ratio.

In this case, work roll diameter D, gear ratio, sheet width W, sheet thickness ($H_s$: sheet thickness on the entry side of the first rolling stand) and yield stress $\sigma_y$ of material measured by a simple tensile test are previously known, so that it is possible to input them into a calculator (not shown) in advance. In this connection, the rolling load described in the specification of the present invention is defined as a load required for plastic deformation of material. In the case where there is provided a profile control device such as a bender in the rolling stand, a force given by the bender is detected. The thus detected force is subtracted from the load detected by the above load cell. In this way, the rolling load of the present invention can be found.

Next, an estimating method of estimating the sheet temperature will be explained as follows. The sheet temperature on the delivery side of the rolling stand is detected by the sheet temperature detector (4) arranged on the delivery side of the rolling mill at regular intervals $\tau$ (for example at regular intervals of 5 sec). In accordance with the thus detected temperature data, sheet temperature in a steady condition is estimated. For example, a control period of tension (a control period of tension to prevent the occurrence of heat scratches) is set at one minute, and data of sheet temperature in the past one minute (in this case, the number of data is 12 when the tension condition is maintained constant) is used, and the data is substituted into a function to express an asymptotic curve which asymptotically comes close to a constant value so as to conduct regression. In this way, a constant of the function is determined, and the asymptotic curve is determined to be an estimated value $T_f$ of the sheet temperature in the steady condition. Examples of the function to express an asymptotic curve which asymptotically comes close to a constant value are: $a \cdot \tan h(cX)$ and $a+b(1-e^{-CX})$. In these functions, a, b and c are constants, and these functions asymptotically come close to a and (a+b) respectively. Accordingly, measured temperature data is substituted into the above functions, and an asymptotic value a or (a+b) is found, and the thus found value is determined to be an estimated value $T_f$ of the sheet temperature in the steady condition.

Apart from the above method, the following method may be adopted. For example, a control period (a control period of tension to prevent the occurrence of heat scratches) of tension is set at 30 seconds, and 6 pieces of temperature data obtained in 30 seconds, which is the control period, are subjected to linear regression, so that the sheet temperature after 30 seconds, which is the successive tension control time, is estimated, and the thus estimated value is determined to be the estimated value $T_f$ of sheet temperature.

Next, setting of the heat scratch control temperature will be explained below. Experiments, in which the work roll speed, ratio of reduction and rolling lubricating condition are changed, are previously carried out so as to find the minimum sheet temperature at which heat scratches occur. The thus found sheet temperature is defined as a critical temperature $T_{Lim}$. This critical temperature may be determined to be a heat scratch control target temperature $T_L$. However, it is preferable that the heat scratch control target temperature $T_L$ is set at a temperature a little lower than the above critical temperature $T_{Lim}$, for example, the heat scratch control target temperature $T_L$ is set at a temperature lower than the above critical temperature $T_{Lim}$ by 3 to 6° C.

As described above, in a rolling stand in which heat scratches tend to occur, in this example, in the fourth rolling stand, the estimated value $T_f$ of the sheet temperature on the delivery side is compared with the aforementioned heat scratch control target temperature $T_L$. When $\Delta T=T_L-T_f$ is positive, there is no possibility that heat scratches will occur. Therefore, rolling is continued as it is. When $\Delta T=T_L-T_f$ is negative, there is a possibility that heat scratches will occur. Accordingly, rolling is conducted after the condition of tension is changed so that the value of $\Delta T$ can become positive. A method of calculation of changing tension will be explained as follows.

First, the coefficient $\mu$ of friction in the process of rolling and the deformation resistance $K_m$ are found. In this case, the deformation resistance of a sheet to be rolled is previously found in a tensile test by finding the constants a, $\epsilon_0$ and n shown in the equation (2).

In this connection, the deformation resistance is affected by the rate of strain and the sheet temperature. For this reason, the deformation resistance $K_m$ found by the equation (2) is not necessarily a correct value in the process of rolling. Therefore, according to the present invention, the simultaneous equations composed of an equation of the rolling load and an equation of the forward slip ratio are solved to find the deformation resistance and the coefficient of friction in the process of rolling. For example, Hill's Equation of Load expressed in the equation (8) is used for the finding the deformation resistance, and Blond & Ford's Equation of Ratio of Advancement expressed in the equation (9) is used for finding the coefficient of friction when these equations are developed into equations to express the deformation resistance and the coefficient of friction. In this connection, suffix E in the equation is a detected value in the process of rolling conducted in the rolling stand concerned, and also suffix E in the equation is a calculated value based on the detected value. In the following explanations, the detected and the calculated value described above are referred to as an actually measured value.

$$K_{mE} = 0.7\sigma_{bE} + 0.3\sigma_{fE} + \frac{P_E}{\sqrt{R'_E(H_E - h_E)\left[1.08 + 1.79r_E - \sqrt{1-r}\,\mu_E\sqrt{R'_E/h_E} - 1.02r_E\right]W}} \quad (8)$$

$$\mu_E = \frac{\ln[H_E(K_{mE} - \sigma_{fE})/h_E/(K_{mE} - \sigma_{bE})]}{2\sqrt{R'_E/h_E}\left[\tan^{-1}\sqrt{H_E/h_E - 1} - 2\tan^{-1}\sqrt{f_{SE}}\right]} \quad (9)$$

provided that, $$r_E = 1 - h_E/H_E, \quad f_{SE} = (V_{0E} - V_{RE})/V_{RE}$$

$$R'_E = R\left[1 + \frac{16(1-v^2)}{W\pi E}\frac{P_E}{H_E - h_E}\right]$$

$$K_{mE} = 1.15a(\varepsilon_m + \varepsilon_0)^n$$

$$\varepsilon_m = 0.4\varepsilon_b + 0.6\varepsilon_f$$

$$\varepsilon_f = -\ln(h/H_s), \quad \varepsilon_b = -\ln(H/H_s)$$

$f_{SE}$: actually measured value of a forward slip ratio, $\mu_E$: actually measured value of a coefficient of friction, $P_E$: actually measured value of a rolling load, R: radius of a roll, $K_{mE}$: actually measured value of a deformation resistance, $\sigma_{bE}$: actually measured value of tension on the entry side, $\sigma_{fE}$: actually measured value of tension on the delivery side, v: Poisson's ratio, E: Young's modulus, $R_E$': actually measured value of a radius of a roll after flattened, $V_{OE}$: actually measured value of sheet speed on the delivery side of a rolling mill, $V_{RE}$: actually measured value of work roll speed, $H_E$: actually measured value of sheet thickness on the entry side, $h_E$: actually measured value of sheet thickness on the delivery side, $r_E$: actually measured value of a ratio of reduction, and W: sheet width In the above equation, there are two unknown numbers. They are a coefficient $\mu_E$ of friction and a constant "a" in the equation $K_{mE}$ of deformation resistance. Others are known numbers, and there are two equations. Consequently, it is possible to solve these equations. In operation, it is preferable that a value 0.05 is used as an initial value of the coefficient $\mu_E$ of friction, and a value found in the tensile test is used as an initial value of the constant "a" in the equation of deformation resistance.

For example, when Ono's Equation is used, rising temperature T' on the interface between the roll and the sheet at the exit of the roll bite can be expressed by the following equation (10).

$$T' = T_{dmax} + T_{fmax} \quad (10)$$

In the above equation, Tdmax is a temperature rise on the interface between the roll and the sheet at the exit of the roll bite which increases in accordance with the generation of heat caused when the sheet is deformed. $T_{dmax}$ is expressed by the following equation (11). $T_{fmax}$ is a temperature rise on the interface between the roll and the sheet at the exit of the roll bite which increases in accordance with the generation of frictional heat. $T_{fmax}$ is expressed by the following equation (12).

$$\left.\begin{aligned} T_{dmax} &= \frac{2\cdot K_m}{\rho_p\cdot C_p}\ln\left(\frac{1}{1-r}\right)\frac{\beta}{\beta + \coth(\eta)} \\ \beta &= (\lambda_p/\lambda_r)/\sqrt{\alpha_t/\alpha_p} \\ \eta &= h_m\sqrt{V_R}/2\sqrt{\alpha_p ld} \end{aligned}\right\} \quad (11)$$

-continued $$\left.\begin{aligned} T_{fmax} &= q_{fm}\frac{\sqrt{\alpha_p}}{\lambda_p}\frac{\beta\sqrt{ld/V_R}}{1+\beta\tanh(\eta)} \\ q_{fm} &= \mu p_m \Delta V \\ h_m &= H(1 - 2r/3), \quad ld = \sqrt{R'(H-h)} \\ p_m &= P/b/ld \\ \Delta V &= (f_s^2 + f_b^2)V_R/2/(f_s/f_b) \\ f_b &= 1 - (1+f_s)(1-r) \end{aligned}\right\} \quad (12)$$

Km: deformation resistance, $\rho_p$: density of a sheet, $C_p$: specific heat of a sheet, r: ratio of reduction, $\lambda_p$: coefficient of thermal conductivity of a sheet, $\lambda_r$: coefficient of thermal conductivity of a roller, $\alpha_p$: diffusivity of heat of a sheet, $\alpha_r$: diffusivity of heat of a roll, $h_m$: average sheet thickness in a roll bite, $V_R$: speed of a work roll, ld: length of a contact arc, $q_{fm}$: average friction heat, $\mu$: coefficient of friction, ΔV: average relative slip speed, R: radius of a roll, H: sheet thickness on the entry side, h: sheet thickness on the delivery side, W: sheet width, P: rolling load, $p_m$: average rolling pressure, and $f_s$: forward slip ratio Physical property values and actually measured values of the rolling stand concerned are substituted into the equations (10) to (12), and also the deformation resistance $K_{mE}$ and the coefficient $\mu$E of friction, which are found by a method using the equations (8) and (9), are substituted into the equations (10) to (12). Due to the foregoing operation, it is possible to find an actually measured value $T_E$' of the temperature rise T' on the interface between the roll and the sheet at the exit of the roll bite of the rolling stand concerned.

Next, in order to estimate a change in temperature when the tension is changed, a rolling load and a forward slip ratio are calculated when only the tension is changed while actually measured values of the rolling stand concerned are used except for the coefficient $\mu_E$ of friction, the deformation resistance $K_{mE}$ and the tension. In this connection, when the tension is changed, it is necessary to prescribe a relation between the tension on the delivery side and the tension on the entry side. For example, the relation is prescribed as follows. An intensity of the tension on the delivery side and an intensity of the tension on the entry side are increased equally, or alternatively an increase in the intensity of the tension on the delivery side is 50% of an increase in the intensity of the tension on the entry side.

For example, the rolling load is calculated by Hill's Equation shown in the equation (1). The forward slip ratio is calculated by Bland & Ford's equation shown in the equation (4). Flattening of a roller is calculated by Hitchcoock's equation shown in the equation (5).

When convergence calculation is conducted using the equation (1) of rolling load and the equation (5) of flattening of a roller, the rolling load can be found, and the forward slip ratio can be found by the equation (4). When the thus found values are substituted into the equations (10) to (12), it is possible to find a temperature rise $T_m$' on the interface between the roll and the sheet at the exit of the roll bite in the case of changing the tension.

That is, it is possible to find an actually measured temperature rise $T_E$' on the interface between the roll and the sheet at the exit of the roll bite of the rolling stand concerned, and also it is possible to find an estimated temperature rise $T_m$' on the interface between the roll and the sheet at the exit of the roll bite of the rolling stand in the case of changing the tension. Strictly speaking, the temperature on the interface between the roll and the sheet at the exit of the roll bite is not equal to the sheet temperature on the delivery side of the rolling stand, however, it is possible to assume that the temperature chanaes are equal to each other when the tension condition is changed. Accordingly, the difference $\Delta T'=T_m'-T_E'$ and the difference $\Delta T=T_L-T_f$ are compared with each other, and a tension condition which satisfies an inequality of $\Delta T'\leqq\Delta T$ can be found when the calculation is repeatedly conducted by Newton's Method. In accordance with the result of the above calculation, the setting value of tension of the rolling mill concerned is changed. It is possible to find several values of tension satisfying the above relation at which no heat scratches are caused. Therefore, an appropriate value of tension may be selected from the above values of tension in accordance with the circumstances of rolling. It is preferable that the minimum value ($\sigma_{baim}$, $\sigma_{faim}$) is selected from those values, and the setting value of tension of the rolling stand concerned is changed in accordance with the selected value.

When an intensity of the thus found tension $\sigma_{baim}$, $\sigma_{faim}$ is high, control may be conducted as follows. The maximum tension $\sigma_{bmax}$ on the entry side of the rolling stand and the maximum tension $\sigma_{fmax}$ on the delivery side, at which the sheet is not broken, are previously found. When the value of $\sigma_{baim}$ is higher than the value of $\sigma_{bmax}$ or when the value of $\sigma_{faim}$ is higher than the value of $\sigma_{fmax}$ or when both values of $\sigma_{baim}$ and ofaim are higher than the values of $\sigma_{bmax}$ and $\sigma_{fmax}$, a temperature rise at which heat scratches are caused is controlled when the tension and the work roll speed are respectively controlled while they are combined with each other.

When either the tension $\sigma_{baim}$ or $\sigma_{faim}$ exceeds $\sigma_{bmax}$ or $\sigma_{fmax}$, it is set at a value not higher than $\sigma_{bmax}$ or $\sigma_{fmax}$ In the process of rolling in which the tension is set at this value, the actually measured value $T_E'$ of temperature rise on the interface at the exit of the roll bite is found, and the temperature rise $T_m''$ on the interface between the roll and the sheet at the exit of the roll bite is found by the same method as described above when only the work roll speed is changed. Accordingly, the difference $\Delta T''=T_m''-T_E''$ and the difference $\Delta T=T_L-T_f$ are compared with each other, and a work roll speed condition which satisfies an inequality of $\Delta T''\leqq\Delta T$ can be found when the calculation is repeatedly conducted by Newton's Method. In accordance with the result of the above calculation, the setting value of tension of the rolling mill concerned and the setting value of work roll speed are changed. When both tension control and work roll speed control are simultaneously conducted as described above, it is possible to prevent the occurrence of heat scratches in a wide range.

In the process of control described above, an amount of difference of the rolling load can be previously estimated. Accordingly, it is possible to control the sheet thickness and sheet profile for preventing inaccurate sheet thickness and defective sheet profile.

Next, according to the present invention, when the sheet width is measured and controlled, the tension distribution is controlled, so that the rolled sheet can be prevented from breaking. The summary is described as follows. The present invention is to provide a rolling method of rolling a cold-rolled sheet by a tandem cold rolling mill, the number of the rolling stands of which is not less than 4, each rolling stand having a profile control unit. The rolling method of rolling a cold-rolled sheet by a tandem cold rolling mill comprises the steps of: measuring sheet widths on the entry and the delivery side of the tandem mill; calculating changes in the sheet widths on the entry and the delivery side of the tandem mill by the measured sheet widths; controlling a profile control unit so that the changes in the sheet widths can not exceed a predetermined allowable value; and rolling the sheet while a tension, the intensity of which is not less than 30% of the deformation resistance of the sheet to be rolled, is given to the sheet at least in the final rolling stand. Also, the present invention is to provide a rolling method of rolling a cold-rolled sheet by a tandem cold rolling mill, the number of the rolling stands of which is not less than 4, each rolling stand having a profile control unit, and the rolling method of rolling a cold-rolled sheet by a tandem cold rolling mill comprises the steps of: virtually dividing all rolling stands of the tandem cold rolling mill into a plurality of independent tandem cold rolling mills so that each divided tandem cold rolling mill composes an independent tandem cold rolling mill; measuring sheet widths on the entry and the delivery side of each independent tandem mill; calculating changes in the sheet widths on the entry and the delivery side of the tandem cold rolling mill by the measured sheet widths; controlling the profile control units of all tandem cold rolling mills so that the changes in the sheet widths can not exceed a predetermined allowable value; and rolling the sheet while a tension, the intensity of which is not less than 30% of the deformation resistance of the sheet to be rolled, is given to the sheet at least in the final rolling stand.

On the basis of knowledge obtained from the result of analysis conducted according to the sheet rolling analysis system, a mechanism of change in the sheet width, which is the essential principle of the present invention, will be explained as follows. In this case, the sheet rolling analysis system is an analysis system in which the analysis of deformation of a sheet conducted by the three dimensional rigidity and plasticity FEM and the analysis of deformation of a roller conducted in accordance with a split model are combined with each other.

Figure 10:
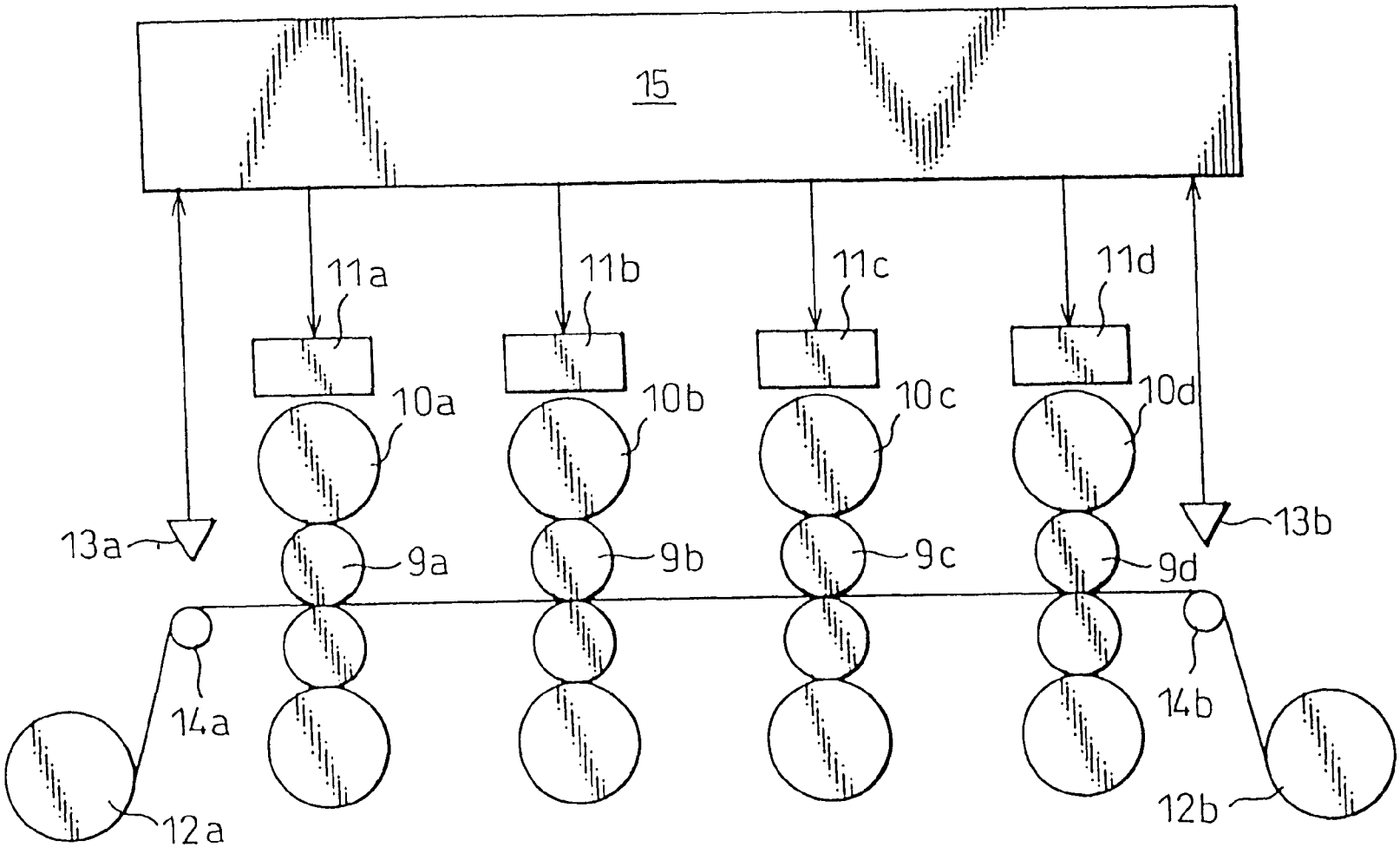
FIG. 10 is a schematic illustration showing a side of the tandem cold rolling mill used for the sheet width control of the present invention.
Figure 11:
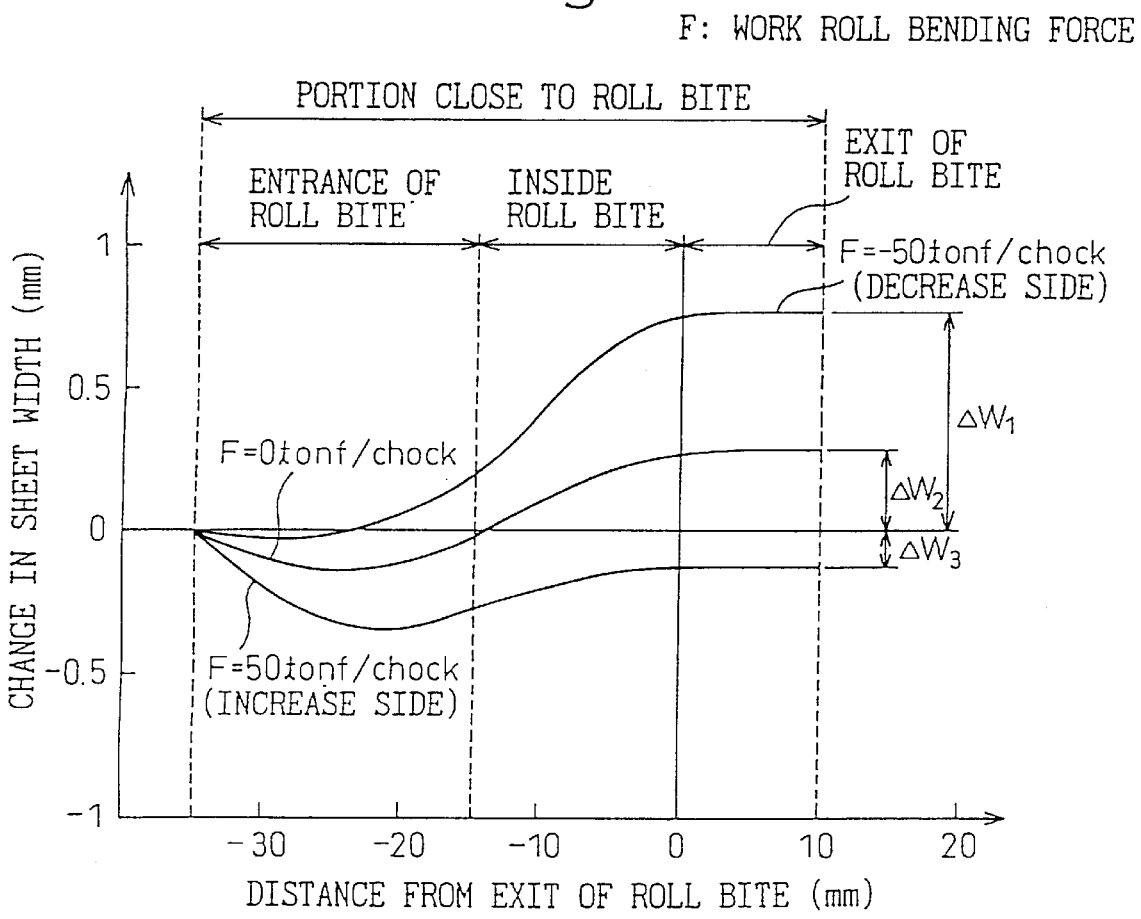
FIG. 11 is a graph showing an outline of a change in the sheet width before and after the roll bite in the case of calculation in which an amount of operation of the profile control unit is changed.
Figure 12:
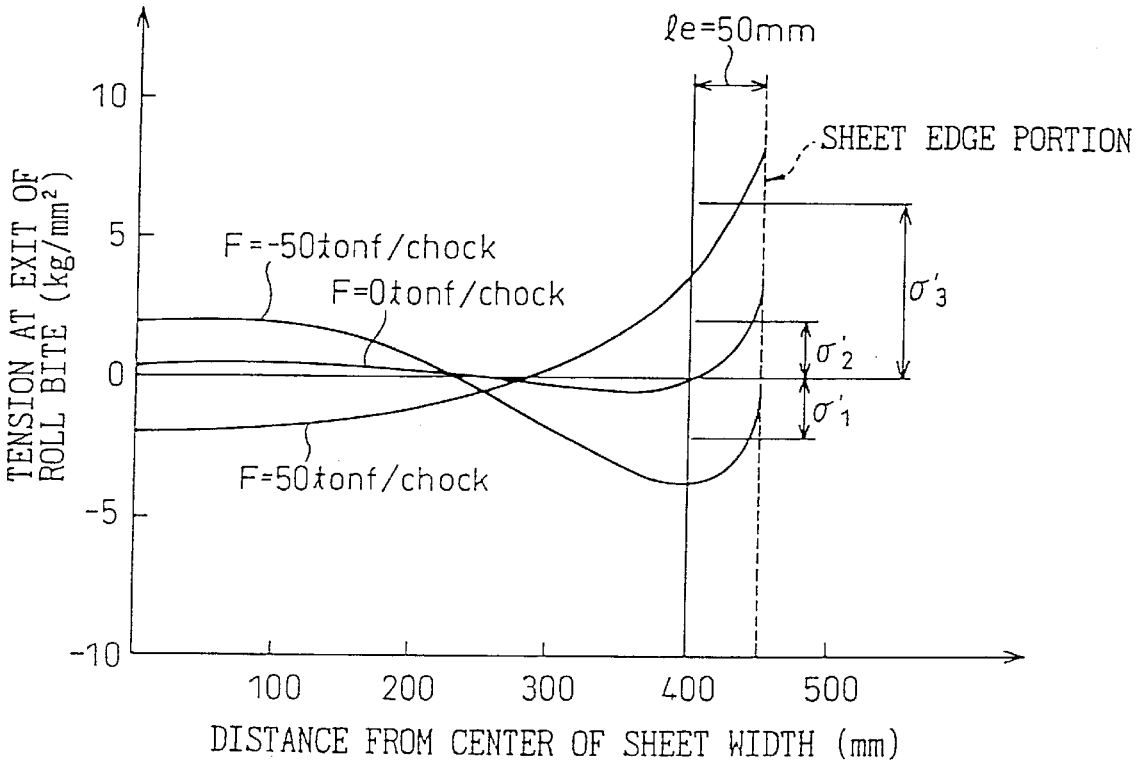
FIG. 12 is a schematic illustration showing a change in the tension distribution at the exit of the roll bite in the case of calculation in which an amount of operation of the profile control unit is changed.

FIG. 10 is a side view showing an example of the tandem cold rolling mill used for sheet width control of the present invention. This tandem cold rolling mill is provided with a profile control device. In this example, the tandem cold rolling mill is provided with a work roll bending device by which an intensity of the force to bend a roll is changed. FIG. 11 is a graph showing changes in the sheet width in a region close to the entrance of the roll bite, a region inside the roll bite, and a region close to the exit of the roll bite when the roll bending force is changed. FIG. 12 is a graph showing a change in the tension in the sheet width direction at the exit of the roll bite. In this case, three regions including a region close to the entrance of the roll bite, a region inside the roll bite, and a region close to the exit of the roll bite are referred to as a region close to the roll bite, hereinafter. As can be seen on these graphs, when a bending force is given to the decrease side of a sheet (the decrease side is defined as a side on which sheet edge portions are elongated: $F<0$), the width is extended in a region close to the roll bite, and concerning the tension distribution, an intensity of tension in a region distant from the sheet edge by 100 mm is lowered. On the other hand, when a bending force is given to the increase side of a sheet (the increase side is defined as a side on which a sheet center portion is elongated: $F>0$), the sheet width is decreased in a region close to the roll bite, and concerning the tension distribution, an intensity of tension in a region distant from the sheet edge portion by 100 mm is increased. As described above, concerning the change in the sheet width in the region close to the roll bite, the higher the intensity of tension at the edge portions of a sheet is increased, the more the sheet width is decreased (shrinkage of width), and the lower the intensity of tension at the edge portions of a sheet is decreased, the more the sheet width is increased (extension of width).

It can be seen that a relation between σ' and ΔW is changed in accordance with the rolling condition (the contact arc length is $l_d$), wherein σ' is an average tension in a sheet edge portion, the distance from the sheet edge of which is $l_e$=50 mm, and ΔW is a change in the sheet width in a region close to the roll bite. Accordingly, the change ΔW in the sheet width in the region close to the roll bite can be expressed by a function of σ' and ld as shown in the following equation (13).

$$\Delta W=\Delta W\ (\sigma', l_d) \tag{13}$$

The average tension σ' in the sheet edge portion is changed according to the rolling condition such as the roll bending force F, the average tension $\sigma_b$ per unit section area on the entry side of the rolling stand, the average tension σf per unit section area on the delivery side of the rolling stand, the sheet thickness h on the delivery side, the sheet width W and the contact arc length ld. This function can be expressed by the following equation (14).

$$\sigma'=\sigma'(F, \sigma_b, \sigma_f, h, W, l_d) \tag{14}$$

As described above, the change in the sheet width, the tension at the sheet edge portion and the rolling condition such as a roll bending force and an average tension are in a close relation with each other shown by the equations (13) and (14). Therefore, according to the present invention, sheet width control is conducted in such a manner that the sheet width is uses as a detecting element, and a fluctuation of tension is replaced with a fluctuation of the sheet width. Due to the above sheet width control, the occurrence of heat scratches and break of a sheet can be prevented. That is, tension is controlled as follows so that the sheet can be prevented from breaking. When an average tension given to the edge portion of the sheet, the intensity of which is an upper limit for preventing the sheet from breaking, is $\sigma'=\sigma'_{lim}$, an allowable change in the sheet width $\Delta W_{lim}$ is determined by the equation (13) in accordance with $\sigma'_{lim}$, and then a change in the sheet width is observed, and an amount of control of the sheet width is determined so that the sheet width can not be decreased to a value which exceeds the allowable change $\Delta W_{lim}$ in the sheet width. In accordance with the thus determined amount of control of the sheet width, the roll bending force F or the average tension $\sigma_b$, $\sigma_f$ on the entry and the delivery side, which is an amount of operation of the profile control device, is found. Due to the foregoing, the occurrence of a break in the sheet caused by an excessively high tension given to the sheet can be prevented. In this connection, it is preferable that the average tension $\sigma'_{lim}$ given to the sheet edge portion, which is a limit value for preventing the sheet from breaking, is set at a value lower than the breaking stress, which was previously found in a tensile test, by a value of 5 to 10 kgf/mm$^2$. In this control method, for the purpose of keeping the productivity high, changing the distribution of tension in the sheet width direction by operating the roll bending force is more preferable than decreasing the tension given to the sheet on the entry and the delivery side.

In this connection, in the explanation of the equation (14), only a bending force given by the roll bending device, which is a profile control device, is discussed. However, it is possible to adopt the following tension control method. With respect to the roll cross device, the roll shaft direction shifting device and the roll profile control device, a relation between the amount of operation and the change in the sheet width is previously found, and the tension including the tension distribution is controlled so that the change in the sheet width can be a value not higher than the above change in the sheet width. Of course, some of the above profile control devices may be simultaneously used so as to control the tension, and these profile control devices may be replaced with the roll bending force.

Next, referring to FIG. 10, the present invention will be explained in detail. FIG. 10 is an arrangement view showing a 4-stand type tandem cold rolling mill by which the sheet 1 is rolled. Each rolling stand is composed of a four-high rolling stand. The four-high cold rolling mill includes work rolls 9*a* to 9*d*, back-up rolls 10*a* to 10*d*, profile control devices 11*a* to 11*d*, and an operation control unit 15. On the entry side of the tandem cold rolling mill, there are provided an entry side coiler 12*a* and an entry side sheet width measuring device 13*a*. On the delivery side of the tandem cold rolling mill, there are provided a delivery side coiler 12*b* and a delivery side sheet width measuring device 13*b*.

As illustrated in FIG. 10, in the tandem cold rolling mill of the present invention, the sheet width measuring devices are arranged at least on the entry and the delivery side of the tandem cold rolling mill, however, it is preferable that the sheet width measuring device is also arranged between arbitrary rolling stands, which will be explained later.

In this example, an output of the main motor of the delivery side coiler 12*b* is not lower than 50% of an output of the main motor of the final rolling stand. Accordingly, it is possible to conduct rolling while a rolling tension, the intensity of which is not lower than 30 to 40% of the deformation resistance of a sheet to be rolled, is given to the sheet.

In the above tandem cold rolling mill, the sheet 1 is rolled while a tension, the intensity of which is not lower than 30 to 40% of the deformation resistance of the sheet, is given to the sheet, and widths $W^{(0)}$, $W^{(4)}$ of the sheet 1 are detected by the sheet width measuring devices 13*a*, 13*b* on the entry and the delivery side of the tandem cold rolling mill. In this case, mark (0) represents the entry side of the tandem cold rolling mill, and mark (4) represents the number of the rolling stand. In the operation control unit 15, an accumulated value of the change in the sheet width at the first to the fourth rolling stand is calculated by the sheet width $W^{(0)}$, $W^{(4)}$ detected on the entry and the delivery side of the tandem cold rolling mill. That is, when a change in the sheet width of the overall tandem cold rolling mill is expressed by $\Delta W^{(1;4)}$, a value of $\Delta W^{(1;4)}$ can be calculated by the equation (15), wherein the first to the fourth rolling stand are represented by the mark (1;4).

$$\Delta W^{(1;4)}=W^{(4)}-W^{(0)}(+\text{:increase in sheet width, }-\text{:decrease-in sheet width}) \tag{15}$$

When the n-th to the N-th rolling stand are represented by the mark (n;N), a value of $\Delta W^{(n;N)}$ can be calculated by the equation (16).

$$\Delta W^{(n:N)}=W^{(N)}-W^{(n-1)} \tag{16}$$

where $\Delta W^{(n;N)}$ is an accumulated change in the sheet width between the n-th to the N-th rolling stand, $W^{(n-1)}$ is a sheet width on the entry side of the n-th rolling stand, and $W^{(N)}$ is a sheet width on the delivery side of the N-th rolling stand.

In the case where this sheet width change $\Delta W^{(1;4)}$ exceeds an allowable value $\Delta W_{lim}{}^{(1;4)}$ on the negative side (the sheet width decreasing side) at which there is a possibility that the sheet is broken in the tandem cold rolling mill, a sheet width correction $\Delta W_C{}^{(1;4)}$ (an amount of correction on the sheet width increasing side) to be corrected in the tandem cold rolling mill is calculated by the equation (17).

$$\Delta W_c^{(1:4)}=\Delta W^{(1:4)}-\Delta W_{lim}^{(1:4)} \quad (17)$$

The above equation can be expressed with respect to the n-th to the N-th rolling stand as follows.

$$\Delta W_c^{(n:N)}=\Delta W^{(n:N)}-\Delta W_{lim}^{(n:N)} \quad (18)$$

where $\Delta W_C^{(n;N)}$ is an amount of correction of the sheet width in the n-th to the N-th rolling stand, and $\Delta W_{lim}^{(n;N)}$ is an allowable value of the sheet width change in the n-th to the N-th rolling stand. When an allowable value of the sheet width change of the i-th rolling stand found by the equation (13) is $\Delta W_{lim}^{(i)}$, wherein i=1 to 4, and when a change in the sheet width in the i-th rolling stand is $\Delta W^{(i)}$, wherein i=1 to 4, in the case where there is a change of $\Delta W^{(i)}-\Delta W_{lim}^{(i)}$ in one of the rolling stands of the tandem cold rolling mill, there is a possibility that the sheet will be broken. Accordingly, the allowable value $\Delta W_{lim}^{(1;4)}$ of the overall tandem cold rolling mill is calculated by the equation (19) while the minimum value of $\Delta W^{(i)}-\Delta W_{lim}^{(i)}$ is used as a reference.

$$\Delta W_{lim}^{(1:4)}=\Delta W^{(1:4)}-\min(\Delta W^{(i)}-\Delta W_{lim}^{(i)})(i=1\sim4) \quad (19)$$

In the above equation, min( ) represents the minimum value in the i-th rolling stand, wherein i=1 to 4.

With respect to the n-th to N-th rolling stand, the equation (19) can be expressed by the following equation (20).

$$\Delta W_{lim}^{(n:N)}\Delta W^{(n:N)}-\min(\Delta W^{(i)}-\Delta W_{lim}^{(i)})(i=n\sim N) \quad (20)$$

According to this sheet width correction $\Delta W_C^{(1:4)}$, it is possible to determine a specific rolling stand in which there is a possibility that the sheet will be broken. Therefore, a bending force or an amount of shift is adjusted by the profile control device of the specific rolling stand, so that the sheet width can be controlled preferentially. In this way, the sheet break preventing control can be accomplished. In this connection, amounts of control such as an intensity of bending force and an amount of shift of the profile control device are calculated by the equations (13) and (14) in accordance with the sheet width correction $\Delta W_C^{(1:4)}$. In this connection, there is provided no sheet width measuring device between the rolling stands of the tandem cold rolling mill. Accordingly, a rolling stand, the profile control device of which is controlled, is specified by the following method, so that the specified profile control device can be controlled.

Roll bending force $F^{(i)}$ of the i-th rolling stand (i=1 to 4), average tension $\sigma_b^{(i)}$ per unit area of the section of the sheet on the entry side of the rolling stand, average tension $\sigma_f^{(i)}$ per unit area of the section of the sheet on the delivery side of the rolling stand, sheet thickness $h'^{(i)}$ on the delivery side, and contact arc length $l_d^{(i)}$ are found by the setting values and the measured values of the present rolling condition, and the average tension $\sigma'^{(i)}$ of a sheet edge portion of the i-th rolling stand is estimated, wherein i=1 to 4. There is a highest possibility of break of a sheet in a rolling stand, the value of $\sigma'^{(i)}$ of which is the highest. Accordingly,-this rolling stand is specified as the j-th rolling stand on which controlling operation is conducted. In the calculation of the equation (14), it is necessary to provide an absolute value $W^{(i)}$ of the sheet width on the delivery side of each rolling stand, however, the sheet width change $\Delta W^{(i)}$ at each rolling stand is minute compared with the sheet width $W^{(i)}$. Therefore, it is approximated that the sheet width $W^{(i)}$ is constant at each rolling stand. Sheet width correction $\Delta W_C^{(i)}$ of the j-th rolling stand is determined to be $\Delta W_C^{(j)}=\Delta W_C^{(1:4)}$, and an amount of operation $F_C^{(j)}$ of the profile control device of the j-th rolling stand is calculated by the equations (13) and (14). According to this amount of operation $F_C^{(i)}$, the profile control device of the j-th rolling stand is operated. After the operation, the average tension $\sigma'^{(i)}$ of the sheet edge portion of the i-th rolling stand is found, wherein i=1 to 4. Next, the j-th rolling stand to be controlled is specified. Then, an amount of operation of the profile control device of the j-th rolling stand is set, and control operation is repeatedly conducted by the profile control devices 4*a* to 4*d* until the sheet width change $\Delta W^{(1:4)}$ is decreased to a value not higher than the allowable value $\Delta W_{lim}^{(1:4)}$ on the negative side.

In addition to the sheet width measuring devices arranged on the entry and the delivery side of the tandem cold rolling mill, when a sheet width detecting device is arranged between the k-th and the (k+1)-th rolling stand ($1\leqq k<4$), it is possible to find the sheet width change $\Delta W^{(1;k)}$ between the i=first and the k-th rolling stand, and the sheet width change $\Delta W^{((k+l);4)}$ between the i=(k+1)-th and the fourth rolling stand. By the equation (20), the sheet width change $\Delta W_{lim}^{(1;k)}$ between the i=first and the k-th rolling stand is found, and also the sheet width change $\Delta W_{lim}^{((k+1);4)}$ between the i=(k+1)-th and the fourth rolling stand is found. By the same method as described above, a rolling stand, the profile controlling device of which is controlled as there is a possibility of break of a sheet, is specified between the i=first and the k-th rolling stand, and also a rolling stand, the profile controlling device of which is controlled as there is a possibility of break of a sheet, is specified between the i=(k+1)-th and the fourth rolling stand, and the profile control devices 11*a* to 11*d* are controlled so that the sheet width changes can not exceed the allowable values $\Delta W_{lim}^{(1;k)}$ and $\Delta W_{lim}^{((k+1);4)}$. Compared with the above case, it is possible to control the sheet width more accurately in this case, because the number of the sheet width measuring devices is increased and the number of the rolling stands, the sheet width change of which is unknown, is decreased.

Explanation will be made as follows in an example in which the sheet width is measured on the entry side of the first rolling stand of the tandem cold rolling mill, on the delivery side of the final rolling stand of the tandem cold rolling mill, and on the delivery side of an arbitrary rolling stand, the number of which is at least one, for example, on the delivery side of the k-th rolling stand, on the delivery side of the j-th rolling stand arranged in the downstream of the k-th rolling stand, and on the delivery side of the m-th rolling stand arranged in downstream of the j-th rolling stand. With respect to the rolling stands, on the delivery side of which the sheet width is measured, stand sections are successively composed from upstream to downstream of the sheet flow.

That is, the stand sections are composed between the first rolling stand of the tandem cold rolling mill and the K-th rolling stand arranged upstream of the rolling stand at which the delivery side sheet width is measured, and also between the (K+1)-th rolling stand arranged downstream of the K-th rolling stand and the J-th rolling stand of which the delivery side width is measured, and also between the (J+1)-th rolling stand arranged downstream of the J-th rolling stand and the m-th rolling stand of which the delivery side width is measured, and between the (m+1)-th rolling stand arranged downstream of the m-th rolling stand and the final rolling stand. In this example, the m-th rolling stand is a measuring stand arranged at the most downstream side.

Sheet width changes at the rolling stands can be found by a difference between the entry side sheet width of the first rolling stand and the delivery side sheet width of the K-th rolling stand, a difference between the entry side sheet width of the (K+1)-th rolling stand, that is, the delivery side sheet width of the K-th rolling stand and the delivery side sheet width of the J-th rolling stand, a difference between the entry side sheet width of the (J+1) rolling stand, that is, the delivery side sheet width of the J-th rolling stand and the delivery side sheet width of the m-th rolling stand, and a difference between the delivery side sheet width of the (m+1)-th rolling stand and the delivery side sheet width of the final rolling stand.

As described above, it is possible to calculate a sheet width change by the result of measurement with respect to the stand sections successively composed from the upstream stand to the downstream stand by the rolling stands at which the sheet width is measured. On the other hand, it is possible to previously find an allowable value of the sheet width change by the equation (20) for each measuring stand section. Accordingly, with respect to each stand section, a rolling stand having a high possibility of breaking a sheet so that the profile control device must be operated, is specified, and the profile control device is controlled so that the sheet width change can not exceed the allowable value.

In the above example, the sheet width is measured on the entry side of the tandem cold rolling mill (on the entry side of the first rolling stand), on the delivery side of the tandem cold rolling mill (on the delivery side of the final rolling stand), and on the delivery side of three rolling stands of the tandem cold rolling mill. Even when the number of the rolling stands, at which the measurement of sheet width is conducted, is smaller or larger than the above, it is possible to control the profile control devices when the stand sections are successively formed from the upstream side to the downstream side in the same manner as described before.

It is preferable that the sheet width measuring devices are arranged among all four rolling stands of the tandem cold rolling mill. When the sheet width measuring devices are arranged among all four rolling stands, it becomes possible to detect the sheet width change $\Delta W$ (i=1 to 4) of each of the first to the fourth rolling stands according to the result of measurement of the sheet width on the entry side and the delivery side of each rolling stand. When the profile control devices 11*a* to 11*d* are controlled so that the sheet width changes can not exceed the allowable values $\Delta W_{lim}^{(1)}$ to $\Delta W_{lim}^{(4)}$ on the negative side that have been set at the first to the fourth rolling stand, sheet width control to prevent a sheet from breaking can be accomplished with higher accuracy.

Even if no sheet width measuring devices are arranged among the rolling stands of the tandem cold rolling mill, when the profile detecting devices are arranged among the rolling stands so that the profile of the sheet can be measured or estimated at each rolling stand, it is possible to control the sheet width by the detected values obtained by the profile detecting devices. For example, since there is a high possibility that a sheet is broken in a rolling stand at which a middle portion of the sheet is elongated as compared with both edge portions of the sheet, the profile control device of this rolling stand is preferentially controlled, for example, in such a manner that the profile of the sheet is changed so that both edge portions of the sheet can be elongated as compared with the middle portion of the sheet. Due to the foregoing, the sheet can be prevented from breaking.

When the sheet width measuring devices arranged on the entry and the delivery side of the tandem cold rolling mill are used and also when the sheet width detecting devices or the sheet profile measuring devices arranged among the rolling stands are use to conduct sheet width control, it is possible to accurately specify a rolling stand at which the sheet tension is so high at both sheet edge portions that the sheet tends to break. When rolling control is conducted on this specified rolling stand so that the sheet width can be extended, that is, so that both edge portions of the sheet can be elongated, it is possible to decrease an excessively high tension generated at the sheet edge portions. Therefore, it is possible to conduct rolling without causing break of a sheet in all rolling stands.

In general, in the case of tandem cold rolling, the sheet width is changed in a portion close to the roll bite. Therefore, when a sheet width is controlled in accordance with the sheet width change as described above, it is possible to accomplish a sheet width control with sufficiently high accuracy. However, depending upon the type of a sheet to be rolled, sheet width changes may be caused among the rolling stands. In this case, the sheet width change between the rolling stands is measured or estimated by the factors such as a tension between the rolling stands, sheet temperature and rolling time, and sheet width control must be conducted in accordance with the thus obtained sheet width change caused between the rolling stands.

When the sheet width change does not exceed an allowable value, roll bender control or sheet tension control may be conducted with an actually measured value of sheet width measured by the sheet width measuring device arranged on the delivery side so that the sheet width on the delivery side can coincide with a predetermined target value of sheet width.

EXAMPLES

Example 1

Figure 5:
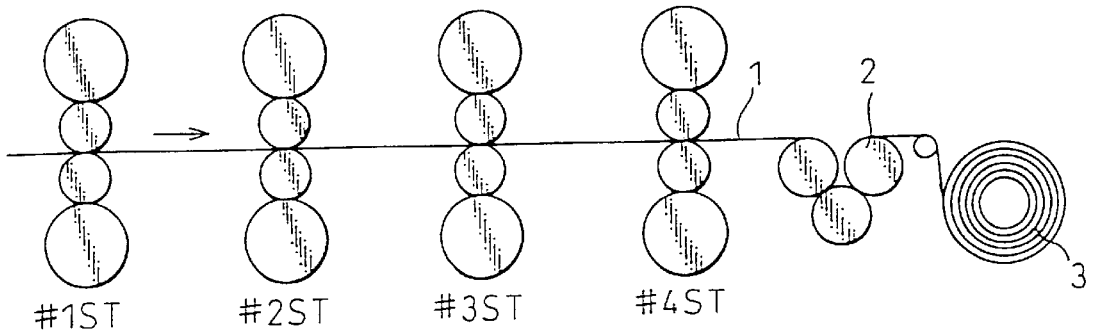
FIG. 5 is an overall arrangement view of the tandem cold rolling mill used in the present invention.

FIG. 5 is an overall arrangement view of the tandem cold rolling mill to which the present invention is applied. As illustrated in FIG. 5, the tandem cold rolling mill is composed of 4-high cold rolling stands, the number of which is 4. The rolling sheet (1) is rolled in each rolling stand and passes through the bridle rollers (2). Then the rolling sheet (1) is wound by the coiler (3). The rolling conditions are described as follows. In this connection, in the case where bridle rollers are provided and an intensity of rolling tension is 20 kgf/mm$^2$, an intensity of tension between the delivery side of the rolling mill and the bridle rollers is 30 kgf/mm$^2$, and an intensity of tension between the delivery side of bridle rollers and the coiler is 10 kgf/mm$^2$. In the case where the bridle rollers are provided and an intensity of rolling tension is 0 kgf/mm$^2$, an intensity of tension between the delivery side of the rolling mill and the bridle rollers is 30 kgf/mm$^2$, and an intensity of tension between the delivery side of bridle rollers and the coiler is 30 kgf/mm$^2$.

Diameter of work roll (D): Φ480 mm

Speed of work roll ($V_R$): 1000 m/min

Tension on entry side ($\sigma_b$): 21.4 kgf/mm$^2$ ($\kappa_b \approx 0.32$)

Tension on delivery side ($\sigma_f$): 30 kgf/mm$^2$ ($\kappa_f \approx 0.40$)

Sheet thickness on entry side (H): 0.84 mm

Sheet thickness on delivery side (h): 0.60 mm

Sheet width (W): 988 mm

Thickness of material to be rolled ($H_s$): 3.2 mm

Material: low carbon steel $\sigma_y = 67(\epsilon + 0.03)^{0.2}$ kgf/mm$^2$

Lubrication for rolling: 2% emulsion of beef tallow (60° C.)

Tension given by bridle rollers.: 0 kgf/mm$^2$, 20 kgf/mm$^2$

Originally, the rolling speed of this tandem cold rolling mill is 1800 m/min. However, when the present invention is applied to this tandem cold rolling mill operated at the rolling speed of 1800 m/min, an output of the coiler motor on the delivery side is insufficient. Therefore, the rolling speed was decreased, so that an amount of work of the coiler on the delivery side was set at a value not lower than 0.5 of an amount of work conducted by the final rolling stand.

The same rolling method as the conventional one was adopted, and tension on the entry side was set at 12 kgf/mm$^2$ ($\kappa_b$=0.18), tension on the delivery side was set at 5 kgf/mm$^2$ ($\kappa_f$=0.07), and tension of the bridle rollers was set at 0 kgf/mm$^2$. Under the above rolling conditions, rolling was conducted and compared with the present invention.

Figure 6:
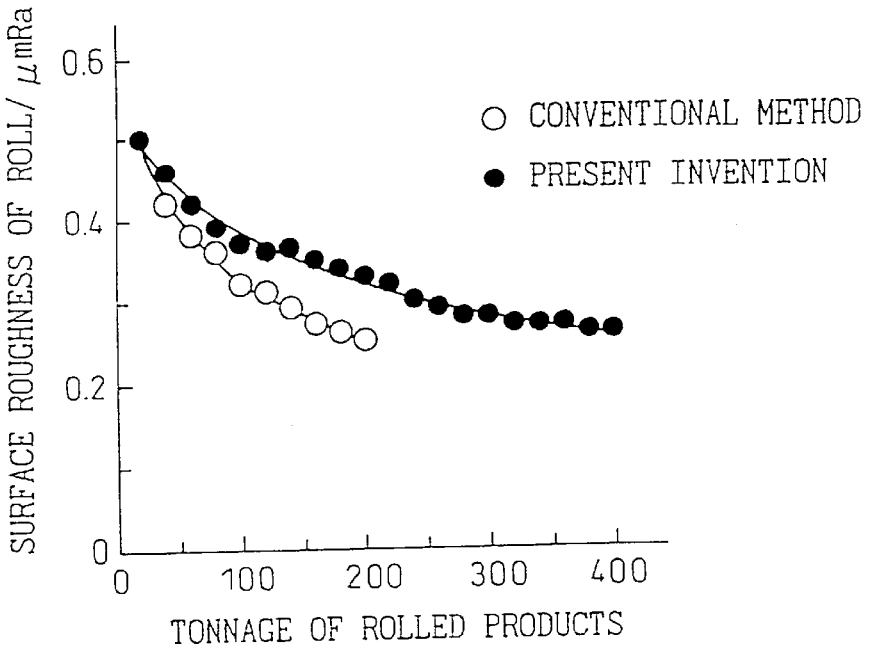
FIG. 6 is a graph showing an effect of the present invention, wherein a relation between the surface roughness of a roll and the tonnage of rolled sheets is shown in FIG. 6.

FIG. 6 is a graph showing the anti-abrasion property of a work roll, wherein the anti-abrasion property is represented by the surface roughness of the work roll. According to the conventional rolling method, when a quantity of rolled sheets had reached about 200 tons, the surface of the work roll became too slippery. Therefore, slipping was caused on the work roll, and the work roll was forced to be changed. However, when the method of the present invention was used, even if a quantity of rolled sheets had reached 400 tons, the surface roughness of the work roll was higher than that of the work roll used according to the conventional method, and no slipping was caused on the surface of the work roll. Consequently, when the present invention was applied, the anti-abrasion property of the work roll was enhanced to twice as high as the anti-abrasion property of the work roll in the conventional rolling method. When the present invention was applied, surface defects, which were usually caused in the conventional rolling method (the ratio of occurrence of surface defects was approximately 2% of the overall production), were not caused at all. This effect was obtained irrespective of the tension generated by the bridle rollers. However, in the case where the bridle roller tension was 0 kgf/mm$^2$, when a sheet of strip was wound into a coil by the coiler, the coil was fastened strongly, so that some defects were caused on the surface of the sheet of strip. In order to prevent the occurrence of the above defects, it is preferable that an appropriate intensity of tension is given to the sheet by the bridle rollers so that an intensity given to the sheet by the coiler can not be mode too high.

In this connection, when an output of the motor to drive the coiler is increased to a value higher than ½ of an output of the motor to drive the final rolling stand, it is not necessary to decrease the rolling speed. Therefore, the productivity can be enhanced.

Example 2

In this example, the same tandem cold rolling mill, which was a 4-stand type 4-high tandem cold rolling mill, as that shown in FIG. 7 was used. The following are the rolling conditions of the fourth rolling stand at which heat scratches tend to occur on the surface of a rolled sheet.

Diameter of work roll (D): Φ480 mm

Speed of work roll ($V_R$): 300 m/min

Tension on entry side ($\sigma_{bs}$): 10 kgf/mm$^2$

Tension on delivery side ($\sigma_{fs}$): 5 kgf/mm$^2$

Sheet thickness on entry side (H): 0.84 mm

Sheet thickness on delivery side (h): 0.60 mm

Sheet width (W): 988 mm

Thickness of material to be rolled ($H_s$): 3.2 mm

Material: low carbon steel $\sigma_y=67(\epsilon+0.03)^{0.2}$ kgf/mm$^2$

Lubrication of rolling: 2% emulsion of beef tallow (60° C.)

In the process of rolling, when a large number of coils of the same size are rolled under the same rolling condition, the average temperature of the work roll is raised, and the sheet temperature on the delivery side of the fourth rolling stand is raised. According to the operation data obtained until now, it was known that heat scratches occur frequently when the sheet temperature on the delivery side of the fourth rolling stand is raised to a value not lower than 173° C. Accordingly, the present invention was applied to the above case so as to make investigation into the effect of the present invention.

According to the previously made experiment, the lower limit of temperature $T_{Lim}$ at which heat scratches occur was 173° C. Therefore, the target control temperature to prevent the occurrence of scratches was set at $T_L$=173−4=169° C. The control period of tension was set at 30 seconds, and the sampling time was set at 5 seconds, and the data, the number of which was 6, obtained in the above 30 seconds were subjected to the operation of linear regression, so that the sheet temperature after 30 seconds was found. The thus found sheet temperature was determined to be an estimated value $T_f$ of the sheet temperature.

Conditions to restrict the tension were determined as follows. The entry side tension $\sigma_b=\sigma_{bs}+\alpha$, and the delivery side tension $\sigma_f=\sigma_{fs}+\alpha/10$. The maximum value $\sigma_{bmax}$ of tension on the entry side at which the sheet was not broken was set at 40 kgf/mm$^2$, and the maximum value $\sigma_{fmax}$ of tension on the delivery side at which the sheet was not broken was set at 10 kgf/mm$^2$.

Figure 8A:
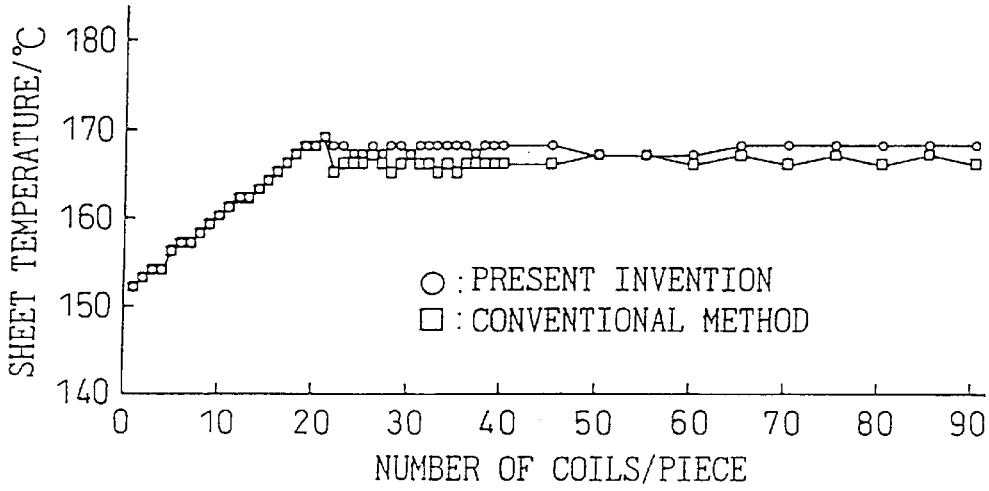
FIG. 8(*a*) is a graph showing a relation between the number of rolled coils and the temperature of a sheet.
Figure 8B:
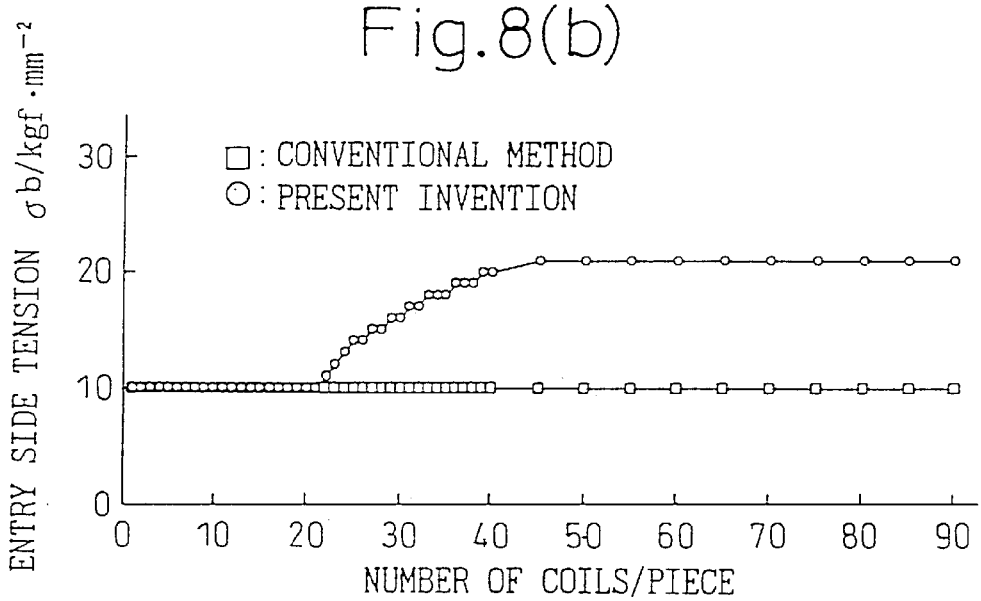

FIGS. 8(*a*) and 8(*b*) are graphs showing the effect of the present invention. FIG. 8(*a*) shows a relation between the number of rolled coils and the sheet temperature on the delivery side of the fourth rolling stand, and FIG. 8(*b*) shows a relation between the number of rolled coils and the tension on the entry side of the fourth rolling stand. Mark □ in FIGS. 8(*a*) and 8(*b*) shows a case of the conventional rolling method, and mark ○ in FIGS. 8(*a*) and 8(*b*) shows a case to which the present invention was applied. According to the conventional rolling method, the estimated value of sheet temperature was raised to a value not lower than 169° C. at the twenty-first coil. Accordingly, there was a possibility of the occurrence of heat scratches, so that the rolling operation was conducted while the work roll speed was reduced to 250 m/min. However, when the method of the present invention was applied, the tension condition was changed at the twenty-second coil, and finally the entry side tension was controlled to a value from 10 kgf/mm$^2$ to 21 kgf/mm$^2$, and even after 90 coils had been rolled, the sheet temperature was not raised to a value not lower than 169° C. Therefore, it was unnecessary to decrease the work roll speed. As a result, no heat scratches occurred.

Example 3

In order to make investigation into the effect of the present invention, the inventors made experiments using the same rolling mill and the same rolling conditions as those of Example 2. Conditions to restrict the tension were determined as follows. The entry side tension $\sigma_b=\sigma_{bs}+\alpha$, and the delivery side tension $\sigma_f=\sigma_{fs}+\alpha/10$. The maximum value $\sigma_{bmax}$ of tension on the entry side at which the sheet was not broken was set at 15 kgf/mm2, and the maximum value $\sigma_{fmax}$ of tension on the delivery side at which the sheet was not broken was set at 10 kgf/mm$^2$.

Figure 9A:
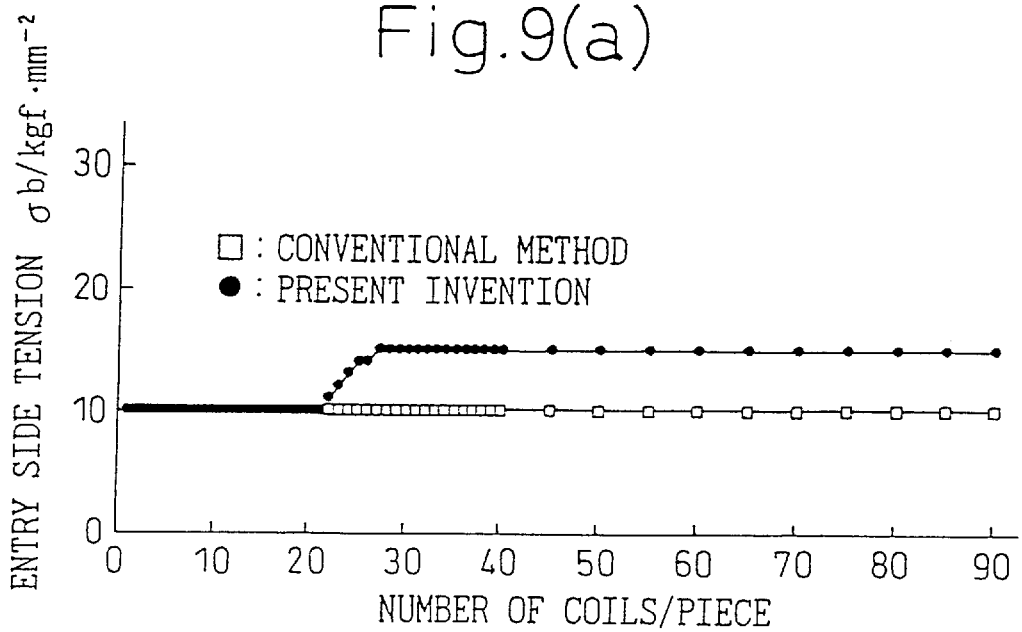
FIG. 9(*a*) is a graph showing a relation between the number of rolled coils and the tension on the entry side according to the method of the present invention.
Figure 9B:
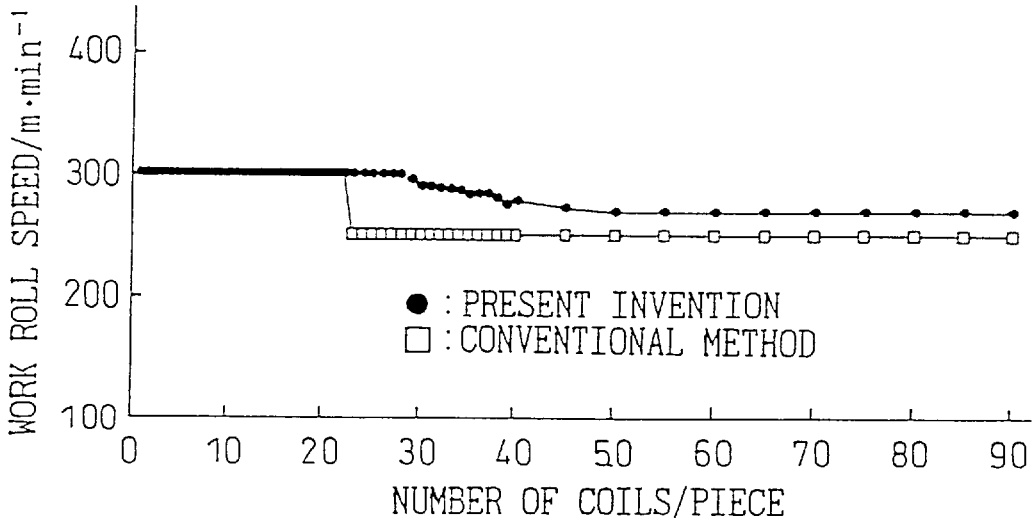

FIGS. 9(*a*) and 9(*b*) are graphs showing the effect of the present invention. FIG. 9(*a*) shows a relation between the number of rolled coils and the tension on the entry side of the fourth rolling stand, and FIG. 9(*b*) shows a relation between the number of rolled coils and the work roller speed of the fourth rolling stand. Mark □ in FIGS. 9(*a*) and 9(*b*) shows a case of the conventional rolling method, and mark ● in FIGS. 9(*a*) and 9(*b*) shows a case to which the present invention was applied. According to the conventional rolling method, the estimated value of sheet temperature was raised to a value not lower than 169° C. at the twenty-first coil. Accordingly, there was a possibility of the occurrence of heat scratches, so that the rolling operation was conducted while the work roll speed was reduced to 250 m/min. However, when the method of the present invention was applied, the tension condition was changed at the twenty-second coil, and finally the entry side tension was controlled to a value from 10 kgf/mm$^2$ to 15 kgf/mm$^2$. At the twenty-seventh coil, the tension on the entry side was increased to a value not lower than 15 kgf/mm$^2$, that is, the tension on the entry side was increased to a value higher than the maximum value of tension at which no sheet breaks occur. Therefore, while the tension on the entry side was maintained at 15 kgf/mm$^2$, the work roll speed was finally reduced from 300 m/min to 268 m/min. Accordingly, even after 90 coils had been rolled, the sheet temperature was not raised to a value not lower than 169° C. Of course, no heat scratches occurred.

INDUSTRIAL APPLICABILITY

According to the present invention, in the case of cold rolling conducted by a tandem cold rolling mill, when an intensity of rolling tension of at least the final rolling stand is set at a value not lower than 30% of the deformation resistance of a sheet to be rolled, that is, when a tension loading ratio is set at a value not lower than 0.3, it is possible to decrease the occurrence of slipping and chattering. Due to the foregoing, great effects can be provided for preventing the occurrence of defects on the surface of a steel sheet. Also great effects can be provided for enhancing the anti-abrasion property of a work roll.

According to the present invention, it is possible to appropriately set the output of the final rolling stand and the output of the coiler system while consideration is given to the tension loading ratio. Therefore, it is possible to provide a tandem cold rolling mill appropriate to decrease the occurrence of slipping and chattering. Further, according to the present invention, rolling tension is controlled so that a temperature rise on the interface between the roll at the exit of the roll bite and the sheet to be rolled can be maintained at a value not higher than the temperature at which heat scratches occur. Therefore, the occurrence of heat scratches can be effectively prevented.

What is claimed is:

1. A tandem cold rolling method of cold-rolling a sheet by a tandem cold rolling mill having an inlet and an exit, the number of rolling stands of which is not less than 4, comprising the step of conducting rolling at least in the final rolling stand while a rolling tension, the intensity of which is not less than 30% of the deformation resistance of the sheet to be rolled, is given to the sheet at the inlet and the exit of the tandem cold rolling mill.

2. A tandem cold rolling method according to claim 1, wherein the intensity of 40–70% of the deformation resistance of the sheet to be rolled is given to the sheet at the inlet and the exit of the tandem cold rolling mill.

* * * * *